US009810188B2

(12) United States Patent
Chazono et al.

(10) Patent No.: US 9,810,188 B2
(45) Date of Patent: Nov. 7, 2017

(54) FUEL INJECTION VALVE

(75) Inventors: Toshiya Chazono, Tokyo (JP); Kazuhiko Kawajiri, Tokyo (JP); Takashi Yonezawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 237 days.

(21) Appl. No.: 14/130,598

(22) PCT Filed: Jun. 20, 2012

(86) PCT No.: PCT/JP2012/065748
§ 371 (c)(1),
(2), (4) Date: Jan. 2, 2014

(87) PCT Pub. No.: WO2013/021733
PCT Pub. Date: Feb. 14, 2013

(65) Prior Publication Data

US 2014/0183286 A1 Jul. 3, 2014

(30) Foreign Application Priority Data

Aug. 8, 2011 (JP) ..... 2011-173070

(51) Int. Cl.
*F02M 63/00* (2006.01)
*F02M 61/18* (2006.01)

(52) U.S. Cl.
CPC ..... *F02M 63/0033* (2013.01); *F02M 61/184* (2013.01); *F02M 61/1833* (2013.01); *F02M 61/1846* (2013.01); *F02M 61/1853* (2013.01)

(58) Field of Classification Search
CPC ..... F02M 63/00; F02M 63/0033; F02M 61/1833; F02M 61/1846; F02M 61/184
(Continued)

(56) References Cited

U.S. PATENT DOCUMENTS 3,542,293 A * 11/1970 Bishop ..... F02M 61/08 123/188.8
3,587,269 A * 6/1971 Seccombe ..... B21C 37/30 29/90.01
(Continued)

FOREIGN PATENT DOCUMENTS

JP 61 58649 12/1986
JP 7 317628 12/1995
(Continued)

OTHER PUBLICATIONS

International Search Report dated Jul. 24, 2012 in PCT/JP12/065748 Filed Jun. 20, 2012.

*Primary Examiner* — Chee-Chong Lee
(74) *Attorney, Agent, or Firm* — Oblon, McClelland, Maier & Neustadt, L.L.P.

(57) ABSTRACT

Provided is a fuel injection valve capable of stably injecting a fuel formed into a thin film. The fuel injection valve includes: a valve seat including a fuel path and a valve seat portion therein; a valve member including an abutment portion configured to sit on the valve seat portion, for opening and closing the fuel path through separation and contact of the abutment portion away from and with the valve seat portion; and a fuel chamber brought into communication with the fuel path, in which: the fuel chamber includes slit-like injection holes for injecting a fuel; and each of the injection holes has a slit-like shape for making fuel flows to collide against each other in a long axis direction of each of the injection holes to form a liquid film in a direction crossing the long axis direction.

11 Claims, 22 Drawing Sheets

(58) Field of Classification Search
USPC ..... 239/584
See application file for complete search history.

(56) References Cited

U.S. PATENT DOCUMENTS

| | | | | | |
|---|---|---|---|---|---|
| 3,598,314 | A | * | 8/1971 | Bailey | F02M 61/042 239/533.11 |
| 3,613,998 | A | * | 10/1971 | Krauss | F02M 61/08 239/453 |
| 3,641,802 | A | * | 2/1972 | Segro | F02M 61/00 239/546 |
| 3,661,183 | A | * | 5/1972 | Komaroff | F16K 31/0631 137/625.65 |
| 3,680,794 | A | * | 8/1972 | Romann | F02M 51/0675 239/406 |
| 4,057,190 | A | | 11/1977 | Kiwior et al. | |
| 5,921,474 | A | | 7/1999 | Zimmermann et al. | |
| 2002/0011532 | A1 | | 1/2002 | Munezane et al. | |
| 2004/0074996 | A1 | | 4/2004 | Munezane et al. | |

FOREIGN PATENT DOCUMENTS

| | | | | |
|---|---|---|---|---|
| JP | 10 507243 | | 7/1998 | |
| JP | 2000 345944 | | 12/2000 | |
| JP | 2002 39036 | | 2/2002 | |
| JP | 2004 137931 | | 5/2004 | |
| JP | 2004 332543 | | 11/2004 | |
| JP | 2007-46518 | * | 2/2007 | F02M 51/08 |
| JP | 2010 84755 | | 4/2010 | |
| JP | 2010 216412 | | 9/2010 | |
| JP | 2011 190801 | | 9/2011 | |

* cited by examiner

FUEL INJECTION VALVE

TECHNICAL FIELD

The present invention relates to a fuel injection valve used for an internal combustion engine such as an engine of an automobile.

BACKGROUND ART

In a fuel injection valve of an engine, as a particle diameter of an injected fuel becomes smaller, evaporation of the fuel is accelerated. At the same time, the amount of fuel adhering to an inner wall of the engine is reduced to reduce the amount of exhaustion of uncombusted fuel. As a result, a fuel consumption efficiency (fuel efficiency) of the engine is improved to reduce the amount of emission of a harmful gas. As means for atomizing the fuel to be injected, there have been proposed various types of means to appropriately design a shape of an injection hole of the fuel injection valve to reduce a thickness of a film of the injected fuel so as to achieve the atomization. For example, there is disclosed a related art fuel injection valve including two cylindrical injection holes with inclined center axes, which are provided in proximity to each other so that flows of the fuel injected from the injection holes are made to collide against each other to form a liquid film so as to atomize the fuel to be injected (for example, see Patent Literature 1).

There is also disclosed another fuel injection valve including a large number of slit-like injection holes extending in a radial direction, which are arranged in a star-like pattern, in which the flows of the fuel injected from the injection holes form a large number of flat flows having a small fuel liquid layer thickness to atomize the fuel to be injected (for example, see Patent Literature 2). There is also disclosed a further fuel injection valve including a large number of slit-like injection holes arranged in a concentric manner so that the fuel injected from the injection holes forms a pear-like fuel particle cloud to atomize the fuel to be injected (for example, see Patent Literature 3).

Further, there is disclosed a further fuel injection valve including a large number of slit-like injection holes, in which a width of each of the injection valves in a long axis direction of the slit is increased toward an outlet of the injection hole to form a flat flow so as to atomize the fuel to be injected (for example, see Patent Literature 4). Further, there is disclosed a further fuel injection valve including a large number of slit-like injection holes, in which turbulent generating means formed by a concave-shaped groove is provided on an inner wall of each of the injection holes to generate a disturbance in a passing fuel flow so as to atomize the injected fuel (for example, see Patent Literature 5). Further, there is also disclosed a fuel injection valve including injection holes provided across steps formed inside a flow path, in which the fuel is made to collide against an inner surface of each of the injection holes to form a further liquid film so as to achieve the atomization (for example, see Patent Literature 6).

CITATION LIST

Patent Literature

[PTL 1] JP 61-58649 B (Page 2, FIG. 2)
[PTL 2] JP 10-507243 A (Page 7, FIG. 2)
[PTL 3] JP 52-156217 A (Page 2, FIG. 3)
[PTL 4] JP 2004-332543 A (Page 3 to 4, FIG. 1)

[PTL 5] JP 2010-84755 A (Page 7 to 8, FIG. 1)
[PTL 6] JP 2009-103035 A (Page 5 to 8, FIG. 3)

SUMMARY OF INVENTION

Technical Problem

With the related art method of forming the liquid film by the collision between the flows of the fuel injected from the two cylindrical injection holes, however, it is difficult to make the injected fuel flows to collide against each other with high accuracy due to an increase or a decrease in the fuel injection amount and a variation between the injection amounts from the injection holes. As a result, when a position at which the collision occurs is shifted, a linear portion having a large thickness is formed in the vicinity of a center of the formed liquid film. As a result, there is a problem in that the atomization is inhibited to prevent the fuel formed into the thin film from being stably injected.

Moreover, in the related art fuel injection value in which the slit-like injection holes are arranged in the star-like pattern or in the concentric manner, each of the injection holes has a slit-like shape. Therefore, the injected fuel also becomes the liquid film having a flat cross section immediately after the injection. However, at a position farther away from the injection hole, the liquid film contracts into a bar-like shape due to a surface tension to form a portion having a large film thickness. As a result, there is a problem in that the atomization of the fuel is inhibited. The phenomenon of the contraction into the bar-like shape becomes remarkable particularly when the fuel injection amount is small. Therefore, there is a problem in that the fuel formed into the thin film cannot be stably injected.

Further, even in the related art fuel injection valve in which the width of the slit-like injection hole in the long axis direction increases toward the outlet of the injection hole, the liquid film having the flat cross section is formed immediately after the injection. At a position farther away from the injection hole, however, the liquid film contracts into the bar-like shape due to the surface tension to form the portion having the large film thickness. As a result, there is a problem in that the atomization of the fuel is inhibited.

Further, even in the related art fuel injection valve including the turbulent generating means formed by the concave-shaped groove provided in the slit injection hole, the liquid film having the flat cross section is formed immediately after the injection. However, the turbulent generating means such as the concave-shaped groove is formed in the liquid film in a thickness direction. Therefore, the thickness of the liquid film becomes non-uniform, which becomes a factor of the contraction of the liquid film into the bar-like shape without spreading the liquid film. Further, even in the related art fuel injection valve in which the injection holes are arranged across the step formed inside the flow path, the flows of the fuel colliding against each other spread along the inner wall surface of the injection hole to gather. As a result, there is a problem in that the gathered fuel has a liquid column-like shape to prevent the acceleration of the atomization.

The present invention has been made in view of the situations described above, and has an object to provide a fuel injection valve capable of stably injecting a fuel formed into a thin film.

Solution to Problem

According to one embodiment of the present invention, there is provided a fuel injection valve, including: a valve seat including a fuel path and a valve seat portion therein; a valve member including an abutment portion configured to sit on the valve seat portion, for opening and closing the fuel path through separation and contact of the abutment portion away from and with the valve seat portion; and a fuel chamber brought into communication with the fuel path, in which: the fuel chamber includes a slit-like injection hole for injecting a fuel; and the injection hole has a slit-like shape for making fuel flows to collide against each other in a long axis direction of the injection hole to forma liquid film in a direction crossing the long axis direction.

Advantageous Effects of Invention

According to the present invention, the flows of the fuel are made to collide against each other in the long axis direction of the slit to form the liquid film in the direction crossing the long axis direction of the slit. In this manner, the fuel formed into the thin film is stably injected.

DESCRIPTION OF EMBODIMENTS

First Embodiment

Figure 1:
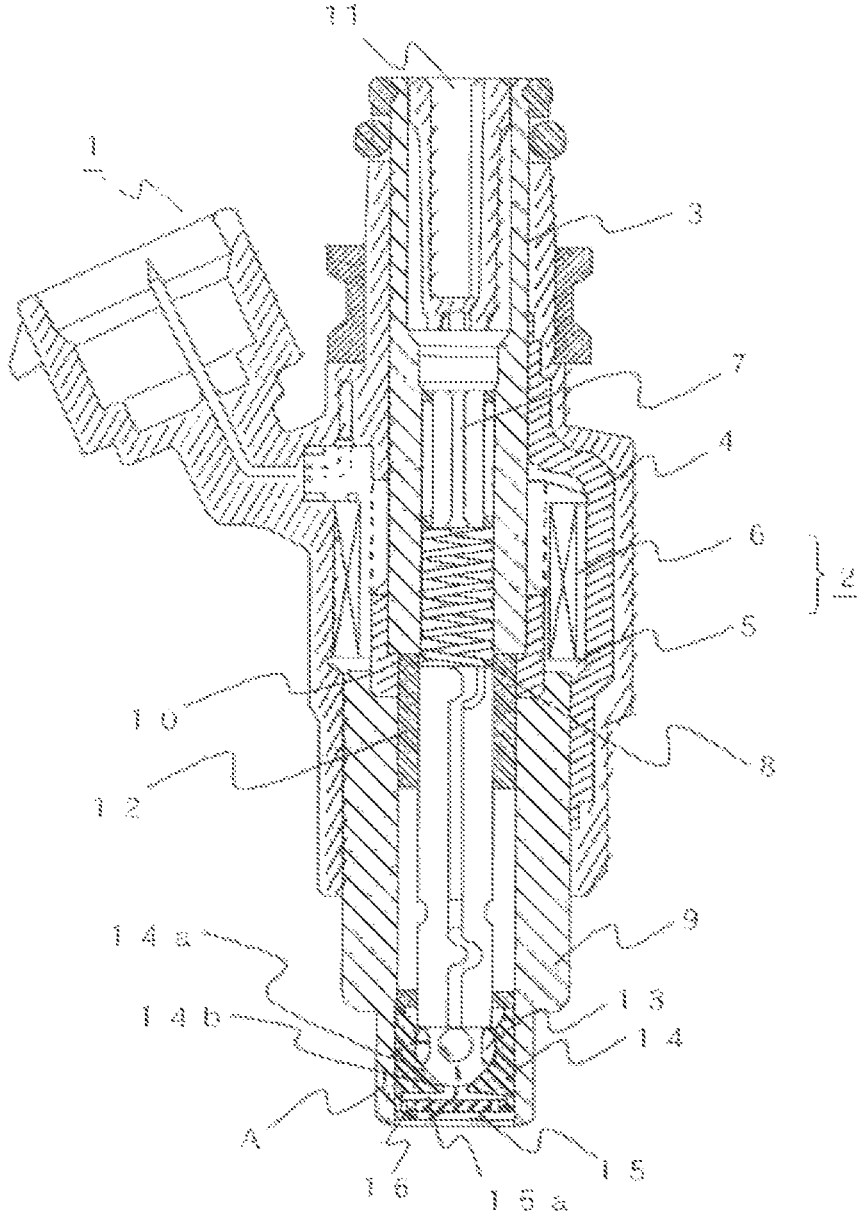
FIG. 1 is a schematic sectional view of a fuel injection valve according to a first embodiment of the present invention.

FIG. 1 is a schematic sectional view of a fuel injection valve taken along an axis direction according to a first embodiment of the present invention. A fuel injection valve 1 includes a solenoid device 2, a core 3, and a yoke 4 which forms a magnetic path. The solenoid device 2 includes a coil assembly 5 and a coil 6 wound around an outer circumference of the coil assembly. Inside the core 3, a rod 7 is fixed. By the rod 7, a load of a spring 8 is adjusted. One end portion of the core 3 is surrounded by the coil assembly 5. To the one end portion, a valve body 9 which forms a magnetic path is provided coaxially with the core 3 through a sleeve 10 therebetween. The sleeve 10 is fastened to the core 3 and the valve body 9 by welding or the like, and is sealed so as not to leak a fuel in the interior. The fuel is supplied from a supply port 11 provided to an upper part of the fuel injection valve 1, and flows inside the fuel injection valve 1 in a direction of a center axis to be injected from injection holes 16 through a fuel chamber 15*a*. One end of the yoke 4 which forms the magnetic path is fixed to the core 3 by welding, whereas the other end thereof is welded to the valve body 9. In this manner, the core 3 and the valve body 9 are magnetically coupled.

An armature 12 is provided inside the valve body 9 through the sleeve 10 therebetween so as to be movable in the fuel injection valve 1 in the center axis direction. One end portion of a valving element 13 which is a valve member is inserted into the armature 12 and fixed by welding. A valve seat 14 is firmly fixed inside a distal end portion of the valve body 9 having a hollow cylindrical shape. The valve seat 14 includes a fuel path 14*b* and a valve seat portion 14*a*. An injection hole plate 15 having the injection holes 16 is fixed by welding to a distal end portion of the valve seat 14. The fuel chamber 15*a* is formed between the injection hole plate 15 and the valve seat 14. The valving element 13 whose one end portion is fixed inside the armature 12 by welding is brought into contact with or is separated away from the valve seat portion 14*a* of the valve seat 14 by a biasing force of the spring 8 adjusted by the solenoid device 2 or the rod 7 to open and close the fuel path. In this manner, the injection and stop of the fuel from the injection holes 16 of the injection hole plate 15 is controlled.

Figure 2:
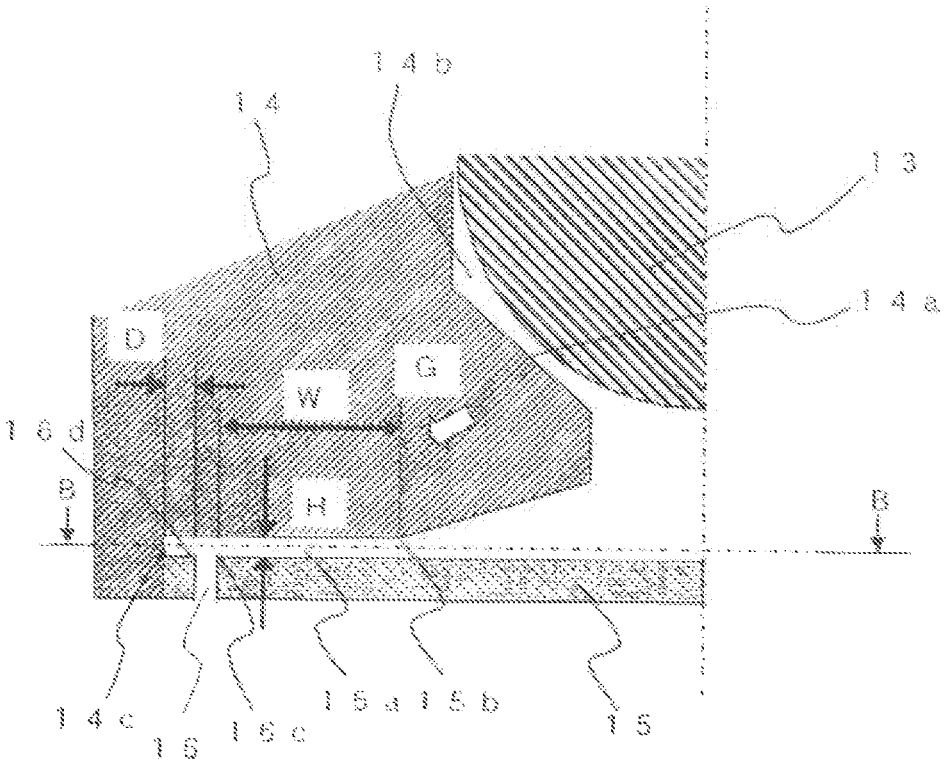
FIG. 2 is an enlarged sectional view of the fuel injection valve according to the first embodiment of the present invention.

FIG. 2 is an enlarged sectional view for exemplifying the vicinity of a region A illustrated in FIG. 1. In this case, only a half part of the fuel injection valve 1 on the left of the center axis is illustrated, and the illustration of the valve body 9 is omitted. The valving element 13 comes into contact with or is separated away from the valve seat portion 14*a* of the valve seat 14 to open and close the fuel path 14*b* corresponding to an internal space of the valve seat 14. A distal end portion of the valving element 13 is formed into a ball-like shape. An outer circumferential portion of the valving element 13 comes into contact with the valve seat portion 14*a*. In this manner, the fuel path 14*b* can be closed. A concave portion, which is surrounded by a wall surface 14*c* and open downward, is formed to a lower portion of the valve seat 14. The injection hole plate 15 is fixed to the opening by welding. The fuel chamber 15*a* is formed between the valve seat 14 and the injection hole plate 15. The slit-like injection holes 16, each having a vertical direction with respect to a paper plane of FIG. 2 as a longitudinal direction and a horizontal direction as a lateral direction, are formed through the injection hole plate 15. The fuel chamber 15*a* is a space having an extremely small height, for rectifying a fuel flow from the fuel path 14*b* in a direction along an upper surface of the injection hole plate 15, and is provided around the center axis of the fuel injection valve 1. The fuel passing through the fuel path 14*b* flows into the fuel chamber 15*a* through an inlet 15*b* of the fuel chamber 15*a*.

A height H of the fuel chamber 15*a* immediately above the injection holes 16 is a distance between an upper end portion 16*c* of the injection hole 16 on the upstream side and a wall surface immediately above the upper end portion 16*c*. Although FIG. 2 illustrates an example where an upper surface and a lower surface of the fuel chamber 15*a* which forms the fuel path are parallel to each other, the upper surface and the lower surface are not necessarily required to be parallel. A distance D is a distance from an upper end portion 16*d* of the injection hole 16 on the downstream side to a wall surface 14*c* of the valve seat 14, and a distance W is a distance from the inlet 15*b* of the fuel chamber 15*a* to the upper end portion 16*c* of the injection hole 16 on the upstream side.

Figure 3:
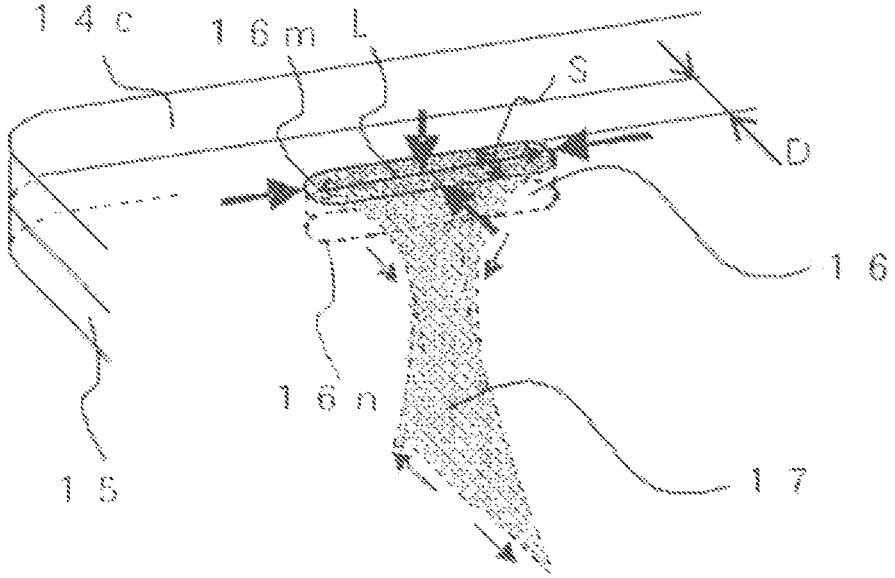
FIG. 3 is a schematic view of an injection hole according to the first embodiment of the present invention.

FIG. 3 is a schematic view for exemplifying a shape of a liquid film 17 injected from the injection hole 16 according to this embodiment. FIG. 3 corresponds to a perspective view in a direction from a view point G illustrated in FIG. 2 to the injection hole 16. For simplification of the description, only the injection hole plate 15, the wall surface 14*c* of the valve seat 14, the injection hole 16, and the liquid film 17 are illustrated. The reference symbol 16*m* denotes an opening of the injection hole 16 on the upstream side, and the reference symbol 16*n* denotes an opening of the injection hole 16 on the downstream side. As illustrated in FIG. 3, the injection hole 16 has a slit-like shape having a length L in a long side direction (long axis direction) and a length S in a short side direction (short axis direction). Flows of the fuel into the injection hole 16 move into the injection hole 16 from both sides of the injection hole 16 in the long side direction, as indicated by thick arrows in FIG. 3. The flows of the fuel flowing into the injection hole 16 collide against each other from the inside of the injection hole 16 to a space directly under the injection hole to form the thin liquid film 17 in a direction vertical to the long side direction of the injection hole 16. More specifically, the liquid film is formed in the long side direction of the injection hole 16 by the flows of the fuel flowing into the injection hole 16 from both sides in the long side direction thereof. At the downstream, the thin liquid film 17 in a direction approximately vertical to the long side direction is formed by the collision between the flows of the fuel flowing inside the injection hole 16.

Figure 4:
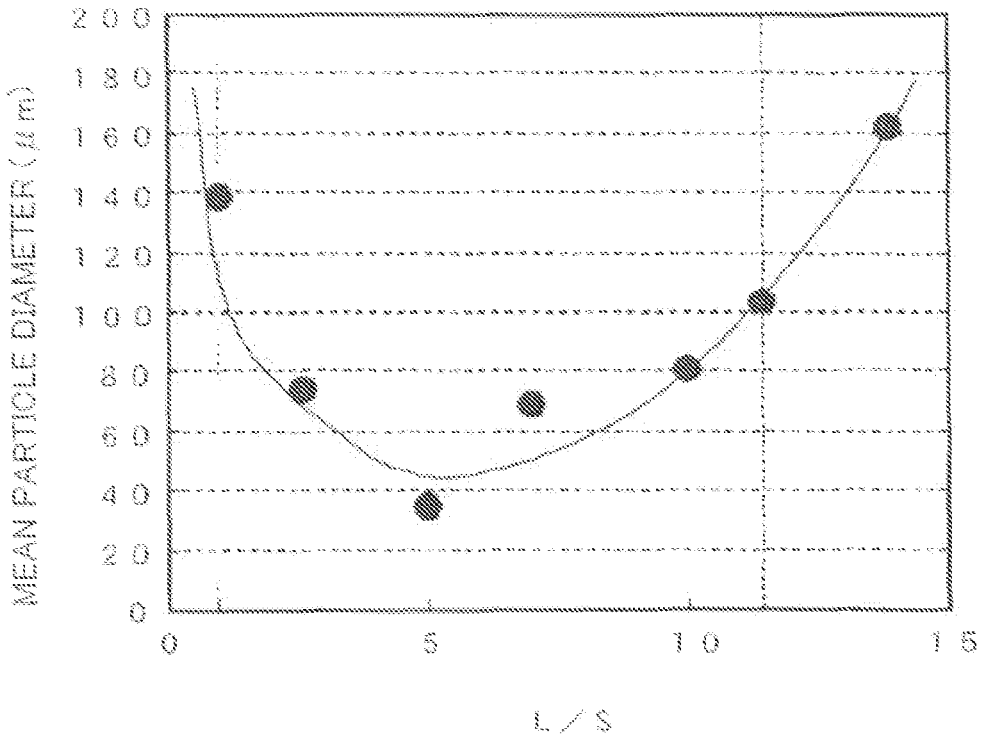
FIG. 4 is a characteristic view of the injection hole according to the first embodiment of the present invention.

FIG. 4 is a characteristic view showing a mean particle diameter of the fuel to be injected when the length L of the injection hole 16 in the long side direction and the length S of the injection hole 16 in the short side direction according to this embodiment are varied. In this case, the mean particle diameters with L/S=1, 2.6, 5, 7, 10, 12, and 14 are plotted.

The mean particle diameter of the fuel to be injected can be measured by a laser diffraction particle-diameter measuring apparatus or the like. FIG. 4 shows the results of measurement of the mean particle diameter at a position about 50 mm away from the injection hole 16 for the fuel to be injected. In this case, the relationship between the height H immediately above the injection hole 16 and the length S of the injection hole 16 in the short side direction is set to H/S<10. As is understood from FIG. 4, the mean particle diameter becomes 100 μm or smaller in the range where L/S is larger than 1 and smaller than 12. It is understood that a flow from the outer side to the inner side is generated inside the injection hole 16 in the long axis direction of the injection hole 16 to achieve atomization. More preferably, L/S is 2 or larger. When L/S becomes larger than 12, the flows in the long side direction are unlikely to collide against each other. As a result, the formation of the liquid film in the direction vertical to the long side direction of the injection hole 16 is inhibited.

More specifically, when L/S is set larger than 12, the length of the injection hole 16 in the long side direction becomes longer. As a result, the collision between the flows of the fuel flowing from both sides in the long side direction becomes weaker. Therefore, a phenomenon that the liquid film 17 is formed in the long side direction of the injection hole 16 to result in a larger mean particle diameter is observed. On the other hand, by setting L/S smaller than 12, the collision between the flows of the fuel in the long side direction becomes stronger to form the liquid film 17 in the direction vertical to the long side direction of the injection hole. As a result, it is found that the mean particle diameter becomes smaller. However, when L/S is set smaller than 1, the collision between the flows of the fuel in the long axis direction becomes too strong. Therefore, a shape of the cross section of the liquid film 17 becomes closer to a circle. As a result, a phenomenon that the mean particle diameter becomes conversely large is observed.

Figure 5:
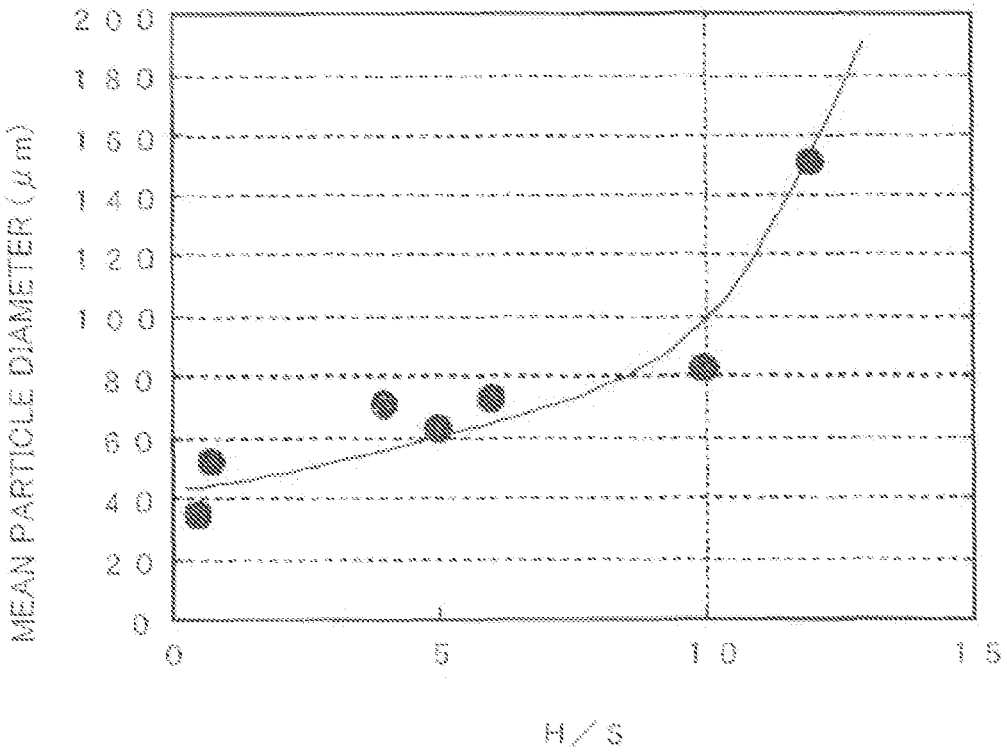
FIG. 5 is another characteristic view of the injection hole according to the first embodiment of the present invention.

FIG. 5 is a characteristic view showing the relationship between the height H immediately above the injection hole 16, the length S of the slit-like injection hole 16 in the short side direction, and the mean particle diameter of the fuel to be injected according to this embodiment. The mean particle diameters with H/S=0.5, 0.7, 4, 5, 6, 10, and 12 are plotted. In this case, the ratio L/S of the length of the slit-like injection hole 16 in the long side direction and the length in the short side direction thereof is constantly set to 5. As can be seen FIG. 5, in the range where H/S is smaller than 10, the mean particle diameter becomes equal to or smaller than 100 μm. It is understood that a flow from the outer side to the inner side inside the injection hole 16 in the long axis of the injection hole is generated to achieve the atomization. Under the above-mentioned conditions, the fuel flows into the injection hole 16 in a state in which a velocity component in the horizontal direction is larger than a velocity component in the vertical direction. As a result, a flow rate in the long side direction of the injection hole becomes higher to increase a collision energy. As a result, the fuel flowing out of the injection hole 16 is injected as the liquid film 17 which is thin in the vertical direction with respect to the long side direction of the slit-like injection hole 16, as indicated by thin arrows illustrated in FIG. 3. Although L/S=5 is set in FIG. 5, the same effects are obtained as long as L/S is within the range of 1 to 12. As actual sizes of the injection hole 16 and the fuel chamber 15*a*, for example, the length L of the slit-like injection hole 16 in the long side direction is about 0.1 to 1.0 mm, the length S thereof in the short side direction is about 0.05 to 0.2 mm, and the height H of the fuel chamber 15*a* is about 0.03 to 0.30 mm.

In general, in the case of the slit-like injection hole, forces of the flows are balanced at the center axis of the injection hole. A distance from a boundary of the injection hole to the center axis of the slit, at which the forces are balanced, is longer in the long axis direction of the slit than in the short axis direction of the slit. Therefore, a flow from the outer side of the slit in the long axis direction to the center axis is generated. Therefore, from the merely slit-like injection hole, the liquid film having the flat cross section is formed immediately after the injection. However, at a position farther away from the injection hole, the liquid film contracts into the bar-like shape to form a portion having a large film thickness due to the flow from the outer side in the long axis direction to the center axis. As a result, the atomization of the fuel is inhibited. The present invention has been made by finding a new phenomenon that the thin liquid film 17 is formed in a direction crossing the long axis direction of the injection hole 16, in particular, in approximately the vertical direction with respect to the long axis direction of the injection hole 16, by intensifying the flows from the outer side of the slit in the long axis direction toward the center axis so that the flows collide against each other from the inside of the injection hole to a space directly under the injection hole.

Moreover, it is experimentally clarified that the velocity component of the fuel in the horizontal direction, which flows into the injection hole 16, can be increased by reducing the height of the fuel chamber 15*a* immediately above the injection hole 16, which enables a collision force of the fuel to be increased. According to the experimental result, it is found that flows from the outer side in the long axis direction to the center axis can be stronger when the height of the fuel chamber 15*a* immediately above the injection hole 16 is set ten times as large as or smaller than the length of the slit-like injection hole 16 in the short axis direction, and the length of the slit-like injection hole 16 in the long axis direction is set larger than one time and smaller than twelve times the length of the slit-like injection hole 16 in the short axis direction. As a result, in the fuel injection valve 1 including the slit-like injection holes 16 described above, the flows of the fuel flowing into the injection holes 16 from the long axis direction collide against each other from the inside of the injection hole to a space directly under the injection hole to then spread in approximately the vertical direction with respect to the long axis direction of the slit to be formed into the thin film. The liquid film 17 is formed by the collision between the flows from the right and left inside the single injection hole. Therefore, a shift does not occur between the flows of the fuel which collide against each other. As a result, the uniform liquid film 17 formed into the thin film can be formed.

Second Embodiment

Figure 6:
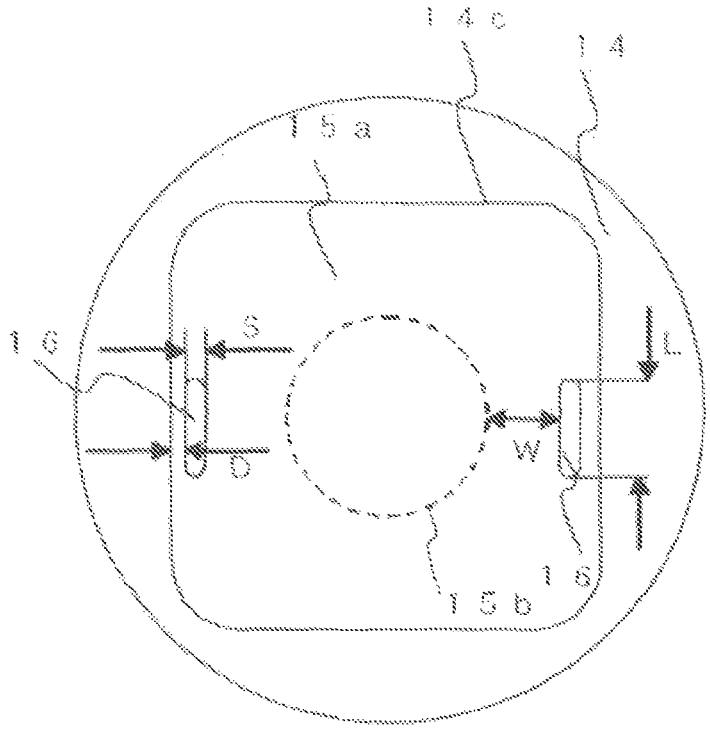
FIG. 6 is a diagram illustrating the arrangement of injection holes according to a second embodiment of the present invention.

The arrangement of the injection holes 16 described in the first embodiment is exemplified. FIG. 6 is a schematic view which exemplifies the arrangement of the injection holes 16 of the fuel injection valve 1 according to this embodiment, and exemplifies a cross section taken along the line B-B shown in FIG. 2. Although FIG. 2 illustrates the cross section of the fuel injection valve 1 of the left half on the center axis, FIG. 6 entirely illustrates the portion around the center axis. A dotted line 15*b* is a virtual line indicating a position of the inlet 15*b* of the fuel chamber 15*a*. In the region surrounded by the inlet 15*b* and the wall surface 14*c*, the fuel chamber 15*a* having the injection hole plate 15 as the lower surface and the valve seat 14 as the upper surface is formed. In this embodiment, in the vicinity of the wall surface 14*c* of the side wall of the fuel chamber 15*a*, the slit-like injection holes 16 are arranged so that the long side direction of each of the injection holes 16 becomes parallel to the wall surface 14*c*. In FIG. 6, a concave portion is formed on a lower surface of the valve seat 14. By fixing the injection hole plate 15 on an opening thereof by welding, the fuel chamber 15*a* is formed between the valve seat 14 and the injection hole plate 15. The length L of the two injection holes 16 in the long side direction and the length S thereof in the short side direction, which are illustrated in FIG. 6, have the relationship: $1<L/S<12$, as described in the first embodiment. Moreover, the height H of the fuel chamber 15*a* and the length S of the injection hole in the short side direction have the relationship: $H/S<10$.

As described above, by arranging the slit-like injection holes 16 in the vicinity of the wall surface 14*c* of the side wall of the fuel chamber 15*a* so that the long side direction becomes parallel to the wall surface 14*c*, the flow of the fuel is rectified by the wall surface 14*c* of the side wall of the fuel chamber 15*a* to intensify the flow in the long side direction of the slit-like injection hole 16. As a result, the reduction of the film thickness of the fuel flowing out of the injection hole 16 is further improved.

In particular, the distance D from the wall surface 14*c* to the injection hole 16 is set equal to or smaller than the length S of the slit-like injection hole 16 in the short side direction ($0\leq D\leq S$). As a result, a vortex inside the injection hole 16, which inhibits the reduction of the thickness of the liquid film, can be suppressed. As a result, the thickness of the liquid film 17 can be further reduced. Moreover, by the effect of rectifying the flow, a pulsation and a pressure fluctuation inside the injection hole 16 can be suppressed. As a result, the generation of air bubbles due to flashing can be suppressed. Therefore, the same spraying characteristic as those obtained under an atmospheric pressure can be obtained even under a negative-pressure atmosphere. The injection hole with $D=0$ can be formed by, for example, the injection hole 16 formed by surrounding a cutout formed on an end portion of the injection hole plate 15 with the valve seat 14 and the injection hole plate 15.

Figure 7:
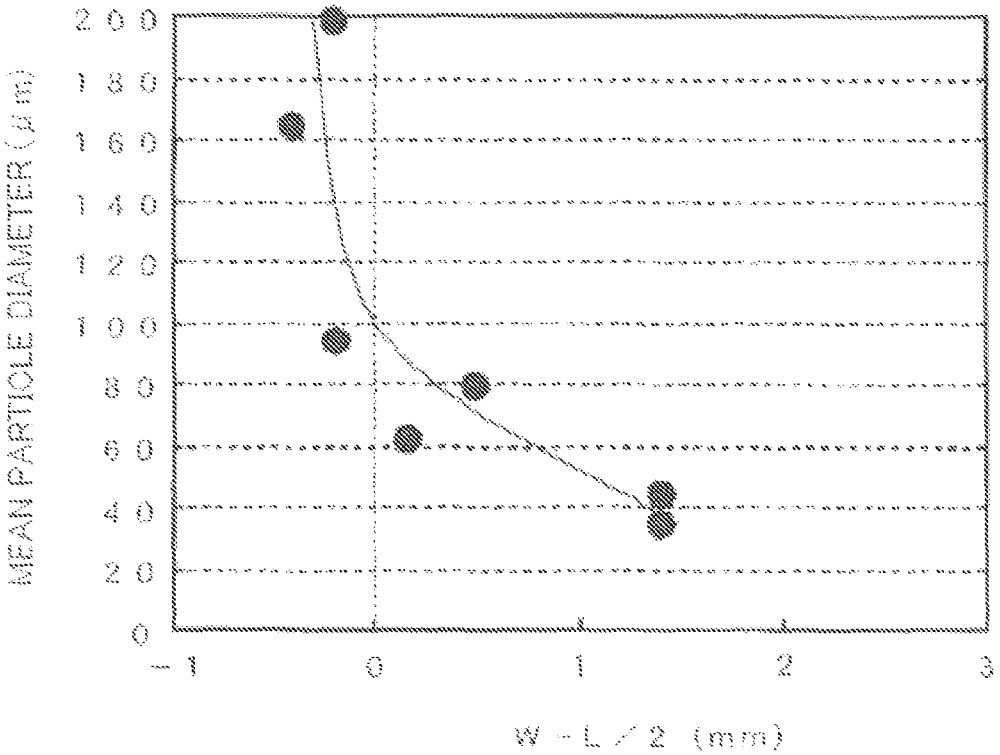
FIG. 7 is a characteristic view of the injection hole according to the second embodiment of the present invention.

The relationship between the distance W from the inlet 15*b* of the fuel chamber 15*a* to the injection hole 16 and the length L of the injection hole 16 in the long side direction is desirably $L/2<W$. FIG. 7 is a characteristic view showing the degree of atomization of the fuel to be injected when the distance W from the inlet 15*b* of the fuel chamber 15*a* to the injection hole 16 and the length L of the injection hole 16 in the long side direction are varied according to this embodiment.

From FIG. 7, the relationship between the distance W from the inlet 15*b* of the fuel chamber 15*a* to the injection hole 16 and the length L of the injection hole 16 in the long side direction is desirably set so that $W-L/2$ is larger than 0, that is, $L/2<W$. By the configuration described above, the flows flowing into the slit-like injection hole 16 from the right and left are intensified. Therefore, the flows in the long side direction of the injection hole 16 are intensified. Therefore, the reduction of the film thickness of the fuel flowing out from the injection hole 16 is further improved. Moreover, by the contact of the valving element 13 with and separation thereof away from the valve seat portion 14*a*, a turbulence generated at the opening of the fuel path 14*b* and a turbulence generated at the inlet 15*b* of the fuel chamber 15*a* are alleviated before reaching the injection hole 16. As a result, the liquid film 17 can be smoothened. Although $L/S=5$ and $H/S=0.5$ are set in this embodiment, the same effects are obtained as long as $1<L/S<12$ and $H/S<10$ are set. As actual sizes of the injection hole 16 and the fuel chamber 15*a*, for example, the distance from the center axis of the fuel injection valve to the injection hole 16 is about 1.0 to 1.6 mm, the distance from the center axis of the fuel injection valve to the inlet 15*b* of the fuel chamber 15*a* is about 0.25 to 1.0 mm, and the distance W from the inlet 15*b* of the fuel chamber 15*a* to the injection hole 16 is about 0.2 to 1.0 mm.

Third Embodiment

Figure 8:
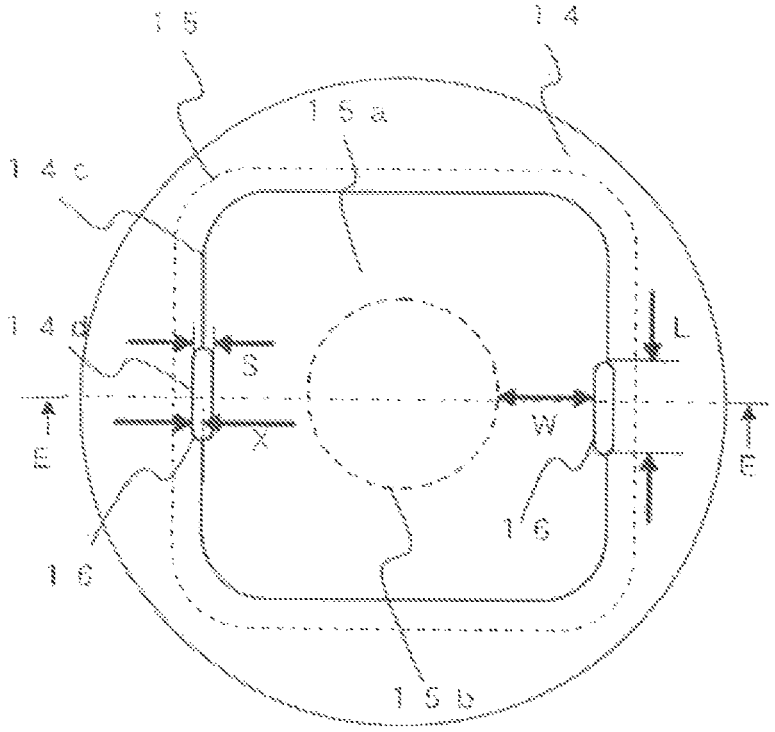
FIG. 8 is a diagram illustrating the arrangement of injection holes according to a third embodiment of the present invention.
Figure 42:
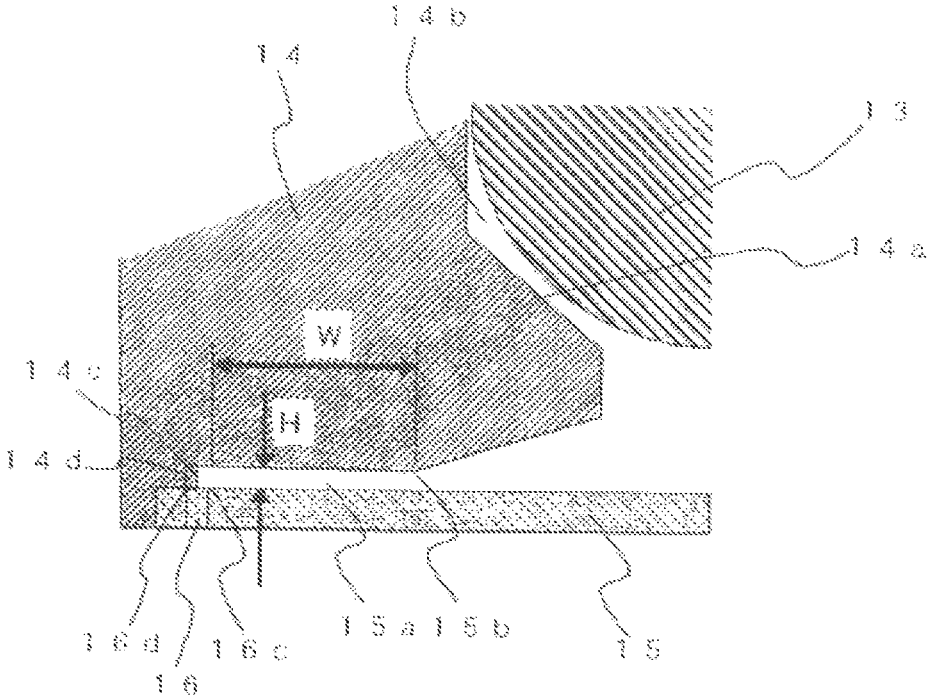
FIG. 42 is a schematic sectional view of the fuel injection valve according to the third embodiment of the present invention.

In the first and second embodiments, the example where the fuel chamber 15*a* has the rectangular sectional shape has been described and illustrated. However, the sectional shape may be various shapes such as an oval. Further, a concave portion may be provided on the wall surface 14*c* of the fuel chamber 15*a* so that the injection hole 16 is provided in the concave portion. FIG. 8 is a schematic view exemplifying the arrangement of the injection holes 16 of the fuel injection valve 1 according to a third embodiment. In the drawings, the same parts as or corresponding parts to those illustrated in FIGS. 1 to 7 are denoted by the same reference symbols, and the description thereof is herein omitted. In FIG. 8, a dotted line 15 indicates the position of the end portion of the injection hole plate 15. FIG. 42 is a schematic view of a cross section taken along the line E-E shown in FIG. 8. In this case, a concave portion 14*d* is provided on the wall surface 14*c* of the fuel chamber 15*a*. The injection hole 16 is provided over a boundary between the inside of the concave portion 14*d* and the outside of the concave portion 14*d*. As a result, the flows of the fuel flowing along the wall surfaces 14*c* can be prevented from flowing into the injection holes 16 in from the short side direction of the injection holes 16.

Figure 25:
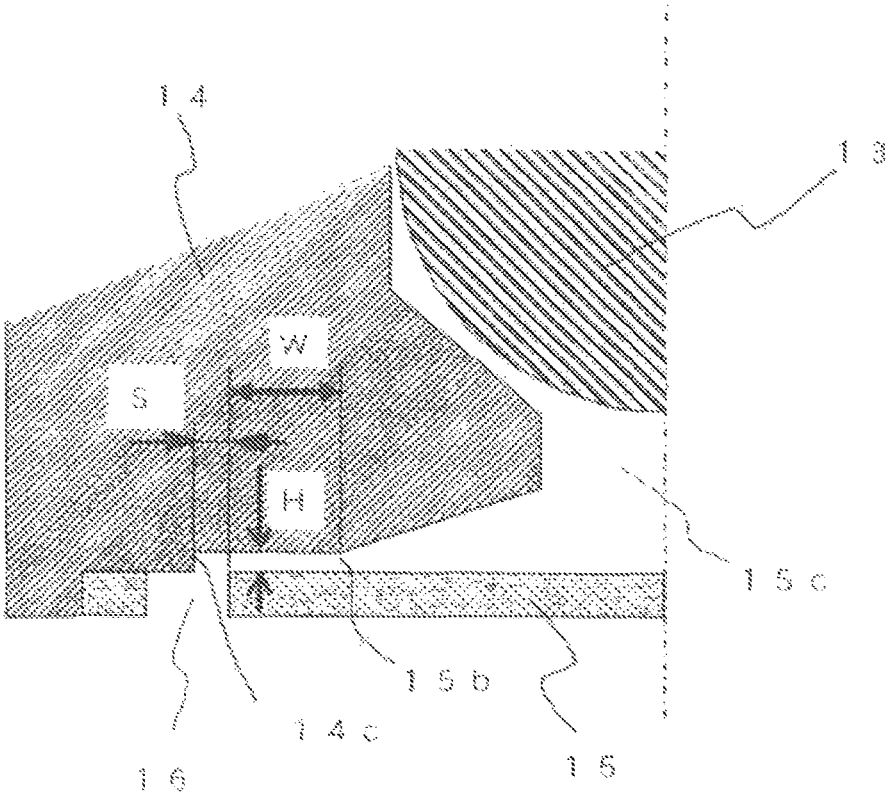
FIG. 25 is a schematic sectional view of a fuel injection valve according to a tenth embodiment of the present invention.

In FIG. 8, the slit-like injection holes 16 are arranged in the vicinity of the wall surface 14*c* of the fuel chamber 15*a* so that the long side direction of each of the injection holes 16 and the wall surface 14*c* are parallel to each other. Moreover, as illustrated in FIG. 42, the concave portion surrounded by the wall surface 14*c* is provided to the lower portion of the valve seat 14. Below the concave portion, the injection hole plate 15 is fixed by welding. As a result, the fuel chamber 15*a* is formed by a gap between the valve seat 14 and the injection hole plate 15. In this case, the concave portion 14*d* is provided on the wall surface 14*c* of the fuel chamber 15*a*, and the injection hole 16 is provided over the boundary between the inside and the outside of the concave portion 14*d*. In this manner, the injection hole 16 is configured so that an end of the wall surface 14*c* is located in the middle of the opening of the injection hole, as viewed laterally. However, as illustrated in FIG. 25 referred to below, the wall surface 14*c* may be provided above the injection hole 16. The length L of the injection hole 16 in the long side direction and the length S thereof in the short side direction have the relationship: $1<L/S<12$, as in the case of the first embodiment. The relationship between the height H of the fuel chamber 15*a* and the length S of the injection hole 16 in the short side direction is $H/S<10$. The amount X of the injection hole 16, which overlaps the wall surface 14*c*, satisfies the relationship: $X<S/2$.

Figure 9:
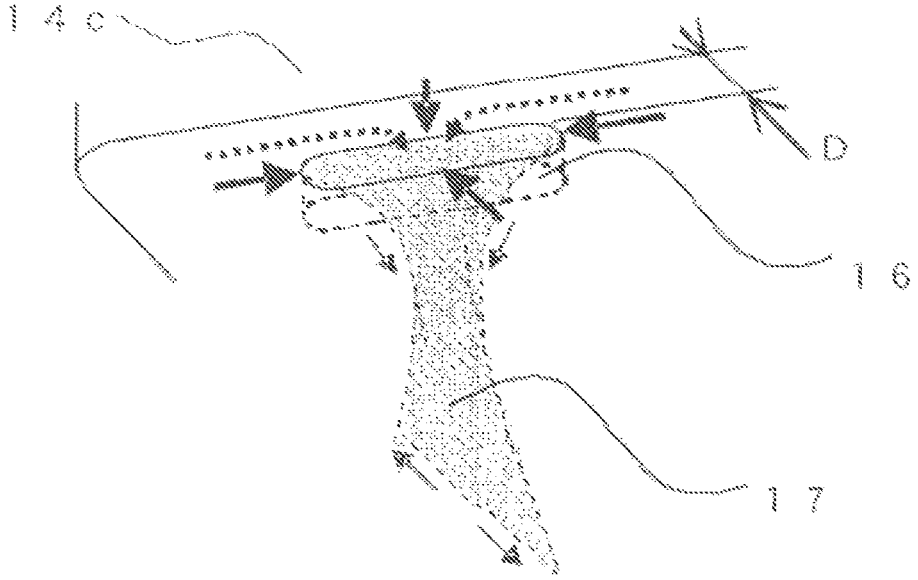
FIG. 9 is a schematic view for illustrating a flow of a fuel according to the third embodiment of the present invention.

As described above, the slit-like injection hole 16 is formed to pass through the injection hole plate 15 so as to partially overlap the wall surface 14*c* of the side wall of the fuel chamber 15*a*. As a result, there is no gap between the wall surface 14*c* and the injection hole 16. FIG. 9 is a schematic view for illustrating the flows of the fuel in the vicinity of the injection hole 16 in the fuel injection valve 1 according to the third embodiment as illustrated in FIG. 3. In FIG. 9, the arrows indicate the flows of the fuel. Among them, when there are the flows of the fuel passing through the gap between the wall surface 14*c* and the injection hole 16 to flow into the injection hole 16 as in the case of the flows of the fuel indicated by the dotted arrows, the flows of the fuel from the outer side toward the center of the fuel injection valve. As a result, the flows from the center of the fuel injection valve to the outer side become relatively small.

On the other hand, according to the fuel injection valve 1 of this embodiment, the flows of the fuel which pass through the gap between the wall surface 14*c* and the injection hole 16 to flow into the injection hole 16 as the flows of the fuel indicated by the dotted arrows shown in FIG. 9 are not generated. Therefore, as the fuel flow inside the injection hole 16, the flow from the center of the fuel injection valve to the outer side becomes relatively large. The flow of the fuel is unidirectionally pressed from the center of the fuel injection valve to the outer side to be stabilized. As a result, the effect of suppressing the pulsations and the pressure fluctuation in the injection hole 16 is enhanced. As a result, the generation of air bubbles due to flashing can be suppressed to obtain the same spraying characteristics as those under the atmospheric pressure even under the negative-pressure atmosphere. Moreover, the amount X of the injection hole 16, which overlaps the wall surface 14*c*, is smaller than S/2. Therefore, while the fuel is flowing into the injection hole 16, the flow from the center side of the fuel injection valve in the direction toward the wall surface 14*c* is not interrupted by the wall surface 14*c*. Moreover, the flow from the center side of the fuel injection valve in the direction toward the wall surface 14*c* is not weakened either. As described above, the slit-like injection hole 16 is provided to pass through the injection hole plate 15 so as to partially overlap the wall surface 14*c* of the fuel chamber 15*a*. Therefore, the flow of the fuel from the center of the fuel injection valve to the outer side inside the injection hole 16 can be more stably increased. As a result, the reduction of the film thickness of the fuel flowing out of the injection hole 16 can be further improved.

Fourth Embodiment

Figure 10:
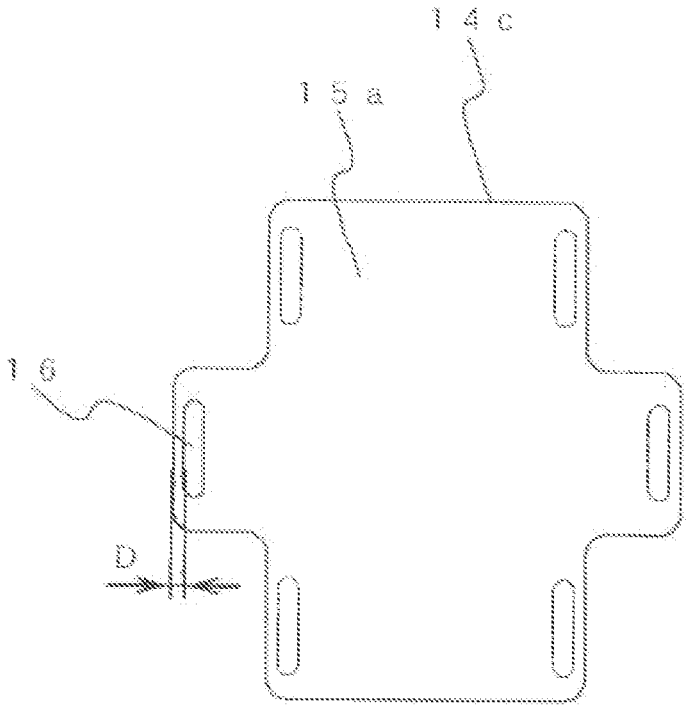
FIG. 10 is a diagram illustrating the arrangement of injection holes according to a fourth embodiment of the present invention.

In the first to third embodiments, the example where one injection hole 16 is provided on each side of the center axis of the fuel injection valve 1 has been described and illustrated. However, the present invention can be carried out with various numbers and arrangements of the injection holes 16. FIG. 10 is a schematic view illustrating the arrangement of the injection holes 16 of the fuel injection valve 1 according to a fourth embodiment of the present invention. In the drawings, the same parts as or corresponding parts to those illustrated in FIGS. 1 to 7 are denoted by the same reference symbols, and the description thereof is herein omitted. In this embodiment, as in the case of the second embodiment, six slit-like injection holes 16 are arranged in the vicinity of the wall surface 14*c* of the side wall of the fuel chamber 15*a* so that the long side directions become parallel to the wall surface 14*c*. In FIG. 10, the wall surface 14*c* formed by the outer circumferential portion of the valve seat 14 is provided on the outer circumference of the fuel chamber 15*a*. In the vicinity thereof, the six slit-like injection holes 16 are arranged so that the longitudinal directions become parallel to the wall surface 14*c*. The length L of the injection hole 16 in the long side direction and the length S thereof in the short side direction have the relationship: $1<L/S<12$, as in the case of the first embodiment. The relationship between the height H of the fuel chamber 15*a* and the length S of the injection hole in the short side direction is $H/S<10$.

When the long side directions of the six slit-like injection holes 16 are approximately parallel to each other as in this embodiment, corresponding portions of the wall surface 14*c* of the fuel chamber 15*a*, which is in the proximity of the injection holes 16, are configured approximately parallel. With the configuration described above, the flow of the fuel is rectified by the wall surface 14*c* to intensify the flow in the long side direction of each of the slit-like injection holes 16 as in the case of the second embodiment. As a result, the reduction of the film thickness of the fuel flowing out of each of the injection holes 16 is further improved.

Figure 11:
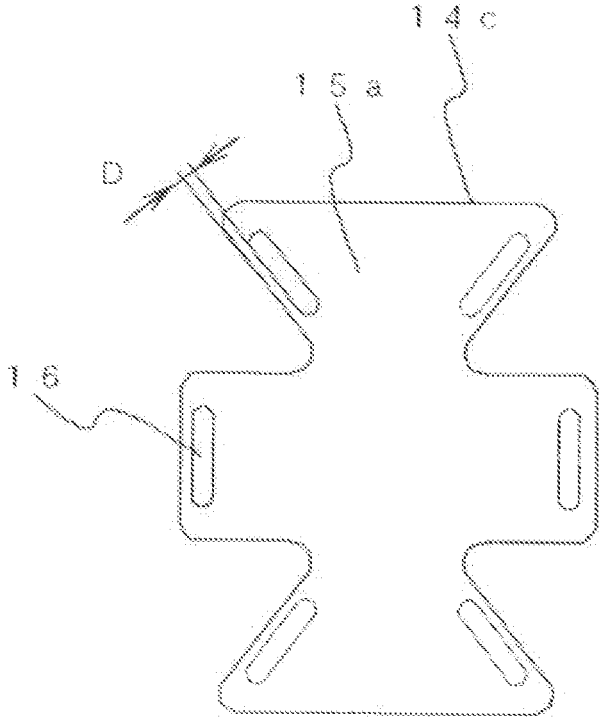
FIG. 11 is another diagram illustrating the arrangement of the injection holes according to the fourth embodiment of the present invention.
Figure 12:
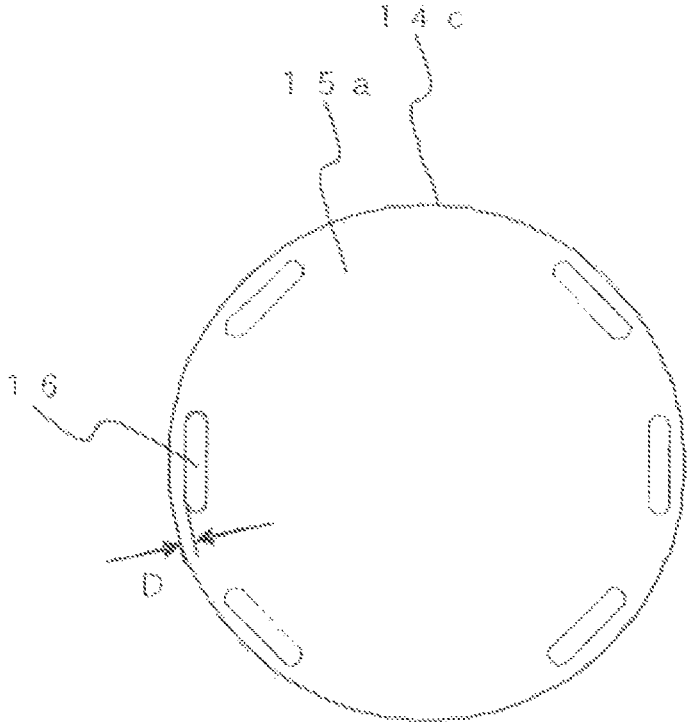
FIG. 12 is a further diagram illustrating the arrangement of the injection holes according to the fourth embodiment of the present invention.
Figure 13:
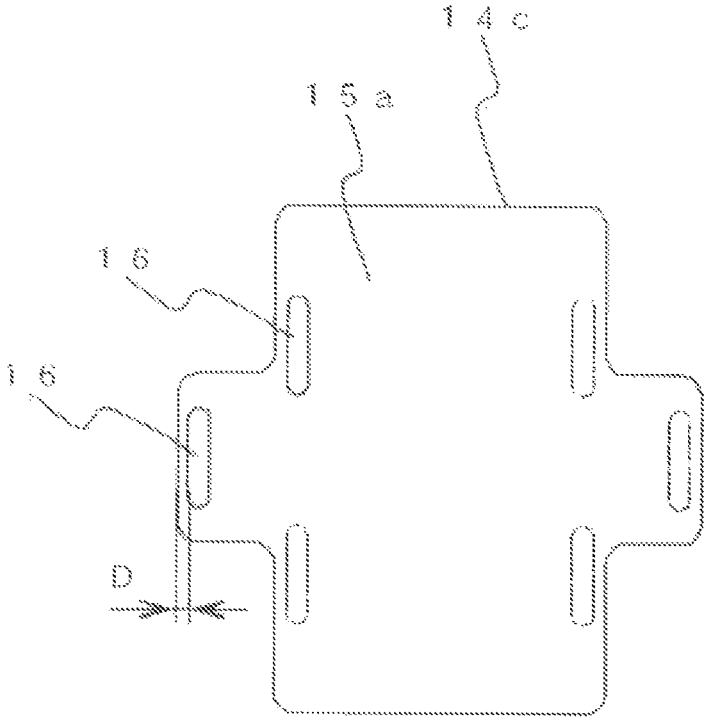
FIG. 13 is a further diagram illustrating the arrangement of the injection holes according to the fourth embodiment of the present invention.

In the case where the long side directions of the six slit-like injection holes 16 are not parallel to each other, as illustrated in FIG. 11 corresponding portions of the wall surface 14*c* in the vicinity of the injection holes 16 only need to be arranged so as to be approximately parallel to the longitudinal directions in accordance with the orientations of the long side directions of the respective injection holes 16. The wall surface 14*c* of the fuel chamber 15*a* is not necessarily required to be linear, but may be circular as illustrated in FIG. 12. In this case, the minimum distance D from the wall surface 14C to each of the injection holes 16 is preferably set equal to or smaller than the length S of each of the slit-like injection holes 16 in the short side direction. Moreover, all the long side directions of the slit-like injection holes 16 are not required to be formed along the wall surface 14*c*. Some of the injection holes 16 may be partially shifted from the wall surface 14*c* so as not to be totally along therewith, as illustrated in FIG. 13.

Fifth Embodiment

Figure 14:
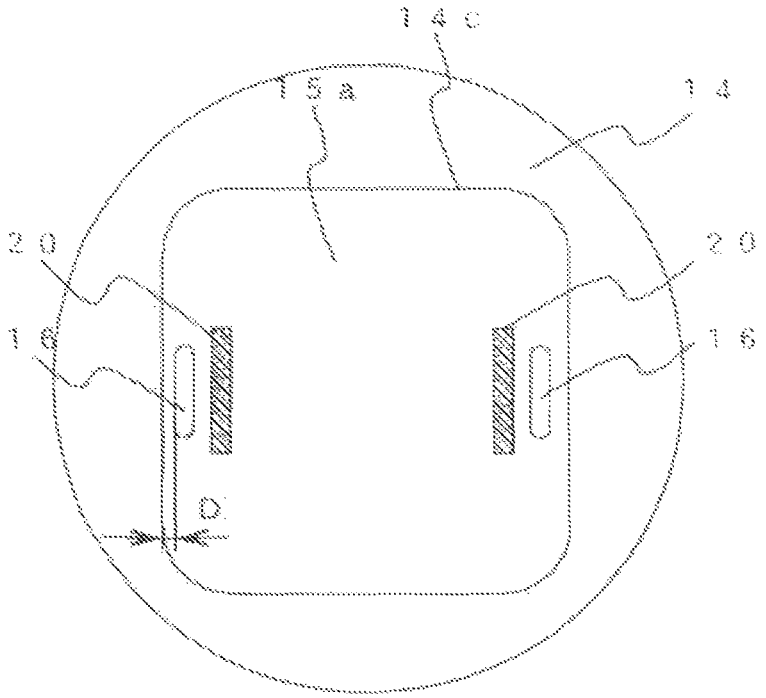
FIG. 14 is a diagram illustrating the arrangement of injection holes according to a fifth embodiment of the present invention.
Figure 40:
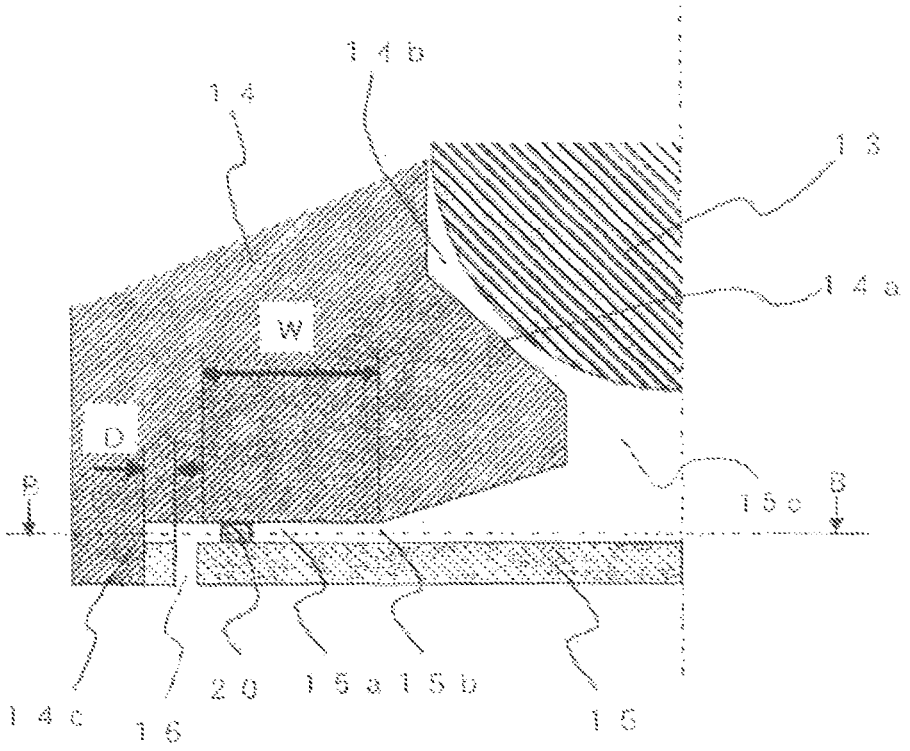
FIG. 40 is a schematic sectional view of a fuel injection valve according to the fifth embodiment of the present invention.

Although the example where there is no barrier between the inlet 15*b* of the fuel chamber 15*a* and each of the injection holes 16 has been described and illustrated in the first to fourth embodiments, a barrier may be provided. FIG. 14 is a schematic view illustrating the arrangement of the injection holes 16 of the fuel injection valve 1 according to a fifth embodiment of the present invention. In the drawings, the same parts as or corresponding parts to those illustrated in FIGS. 1 to 7 are denoted by the same reference symbols, and the description thereof is herein omitted. FIG. 14 is a sectional view taken along the line B-B in FIG. 40. As the injection holes 16 according to this embodiment, the slit-like injection holes 16 are arranged in the vicinity of the wall surface 14*c* of the side wall of the fuel chamber 15*a* so that the long side directions thereof are parallel to the wall surface 14*c*, as in the case of the second embodiment illustrated in FIG. 6. Further, barriers 20 which are approximately parallel to the long side directions are provided in the vicinity of the injection holes 16 on the side opposite to the side wall so as to prevent the fuel from directly flowing from the central portion of the fuel chamber 15*a* into the injection holes 16. The length L of the injection hole 16 in the long side direction and the length S thereof in the short side direction have the relationship: $1<L/S<12$. The relationship between the height H of the fuel chamber 15*a* and the length S of the injection hole in the short side direction is $H/S<10$.

In the thus configured fuel injection valve 1, the flows of the fuel from the central portion of the fuel chamber 15*a* to bypass the barriers 20 into the injection holes 16. Therefore, the flows in the long side direction to the slit-like injection holes 16 are intensified to increase the collision energy between the flows of the fuel. Therefore, the reduction of the film thickness is further improved. In this embodiment, each of the barriers 20 has an oblong horizontal cross section. However, any shape is used for the cross section as long as the flow from the center of the fuel chamber 15*a* into each of the injection holes 16 after bypassing the barriers can be formed. For example, the barriers 20, each having a circular or oval cross section may be used, or a height of the barriers 20 is not required to be constant.

Sixth Embodiment

Figure 15:
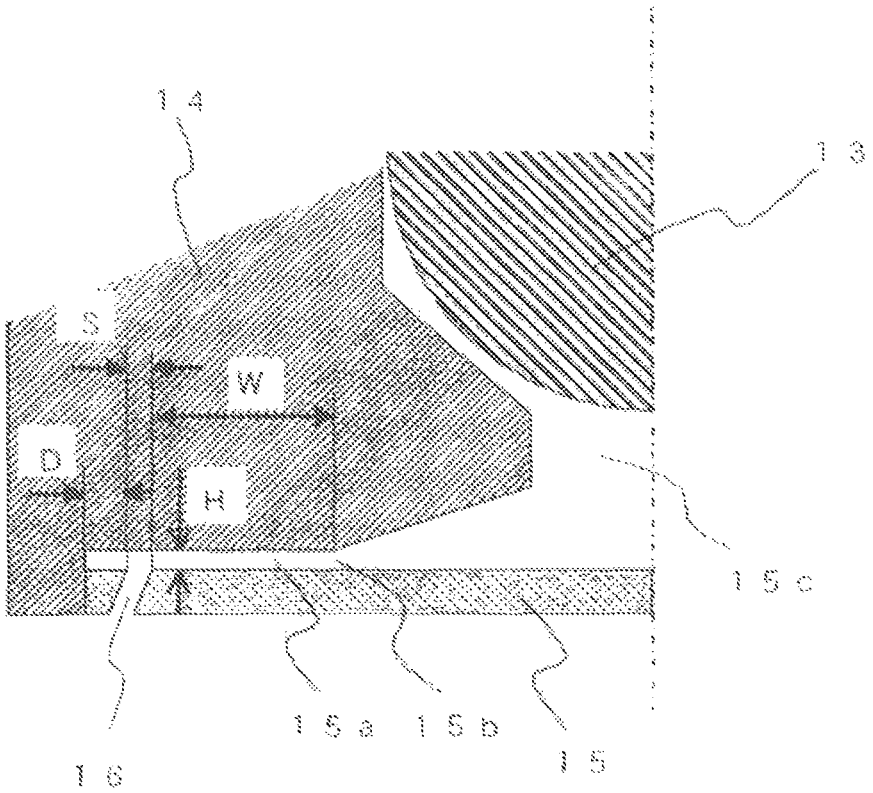
FIG. 15 is a schematic sectional view of a fuel injection value according to a sixth embodiment of the present invention.

Although the example where the sectional shape of each of the injection holes 16 is the same in a depth direction and the center axis of each of the injection holes 16 is vertical has been described and illustrated in the first to fifth embodiments, the center axis of each of the injection holes 16 may be inclined or the sectional shape of each of the injection holes 16 may be varied in the depth direction. FIG. 15 is a schematic view illustrating a cross section of the injection hole 16 of the fuel injection valve 1 according to a sixth embodiment of the present invention. In the drawings, the same parts as or corresponding parts to those illustrated in FIGS. 1 to 7 are denoted by the same reference symbols, and the description thereof is herein omitted. Each of the injection holes 16 according this embodiment is a through hole having a slit-like opening and the outlet side of each of the injection holes 16 is slant toward the outer side in the short side direction.

Figure 16:
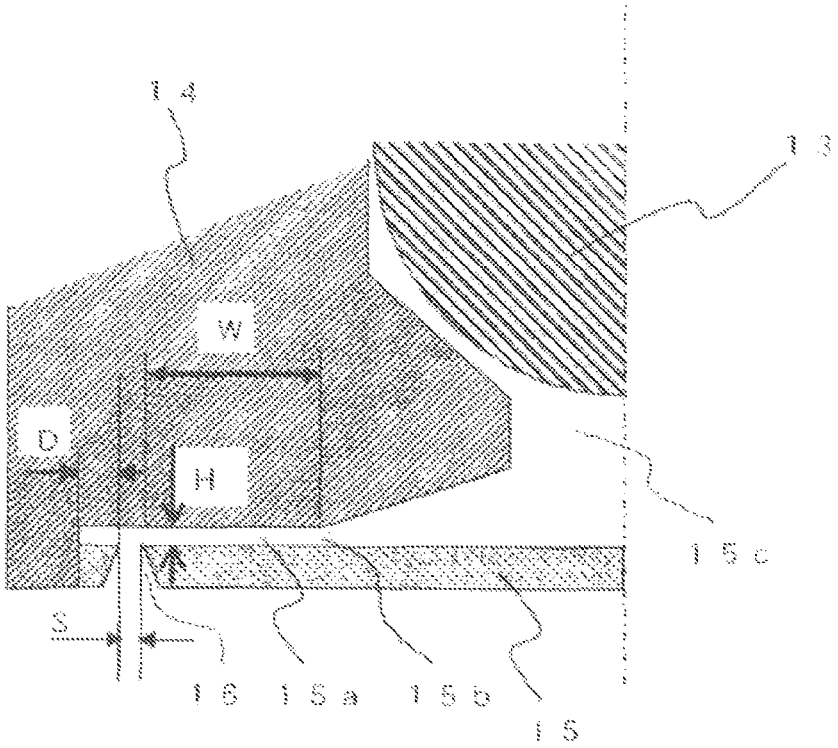
FIG. 16 is another schematic sectional view of the fuel injection value according to the sixth embodiment of the present invention.
Figure 17:
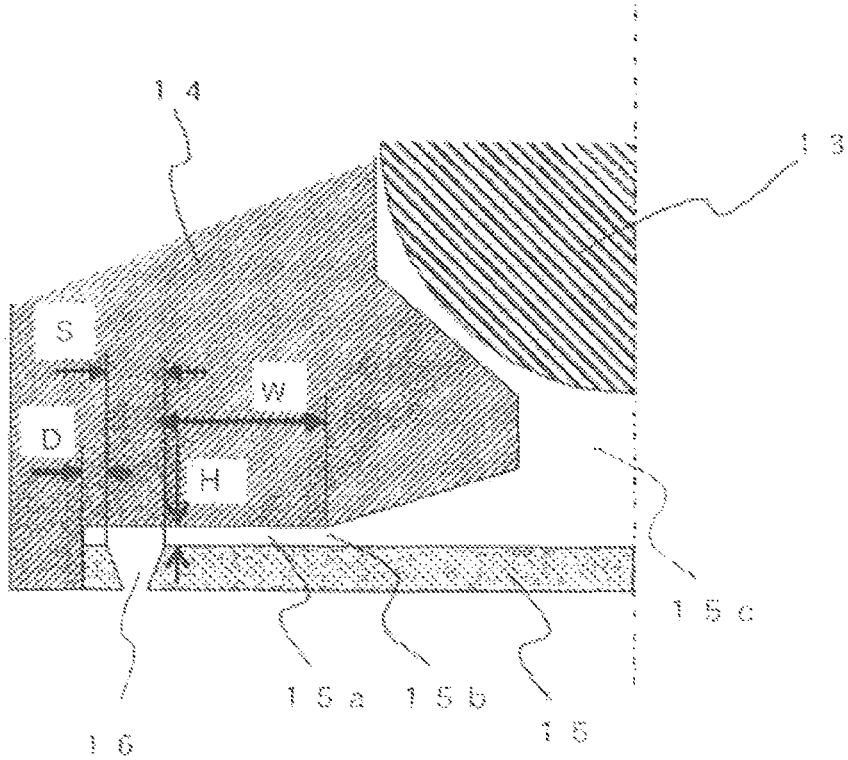
FIG. 17 is a further schematic sectional view of the fuel injection value according to the sixth embodiment of the present invention.
Figure 18:
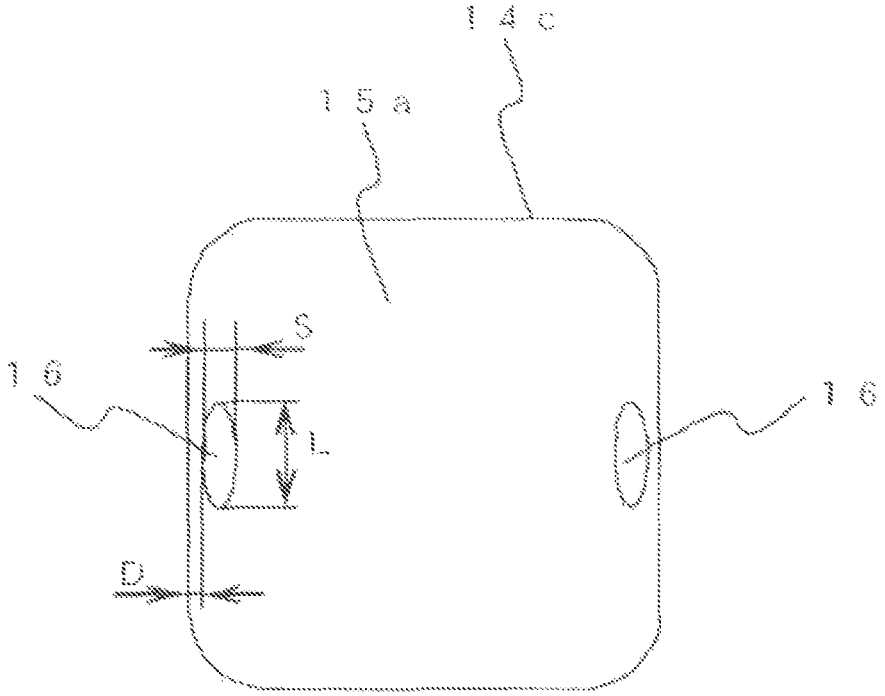
FIG. 18 is a diagram illustrating the arrangement of injection holes according to a seventh embodiment of the present invention.
Figure 19:
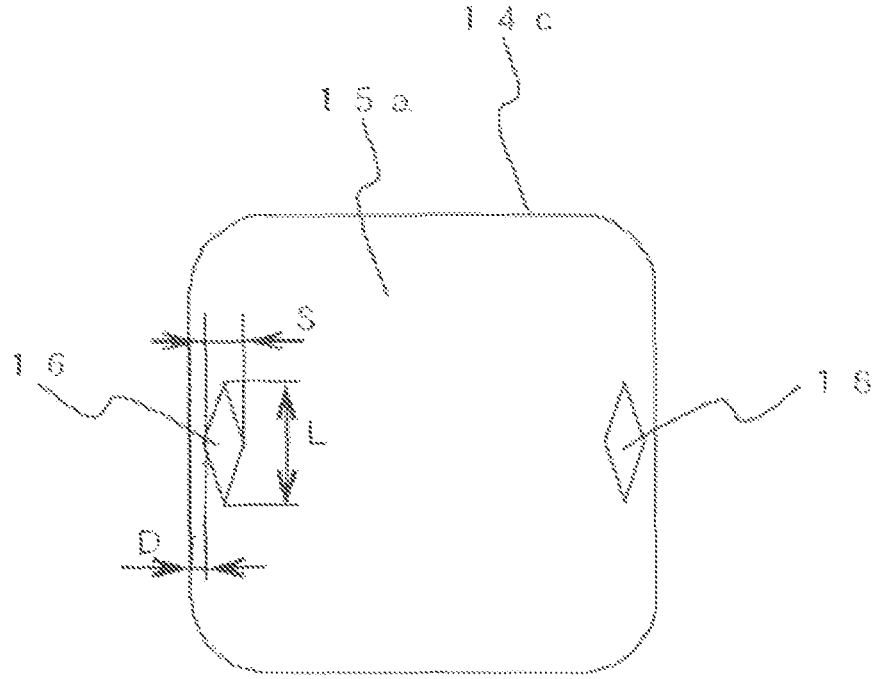
FIG. 19 is another diagram illustrating the arrangement of the injection holes according to the seventh embodiment of the present invention.
Figure 20:
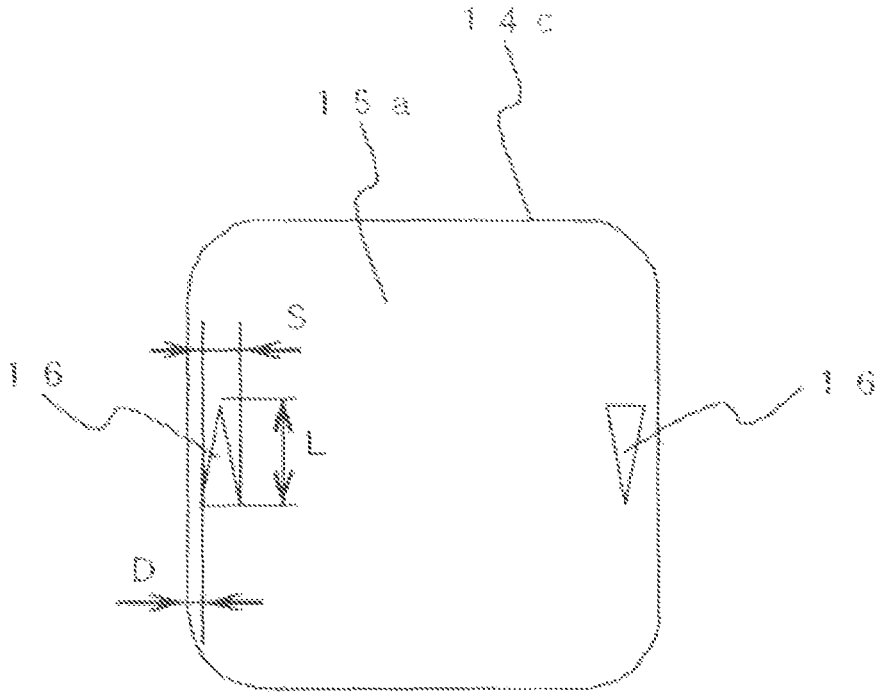
FIG. 20 is a further diagram illustrating the arrangement of the injection holes according to the seventh embodiment of the present invention.
Figure 21:
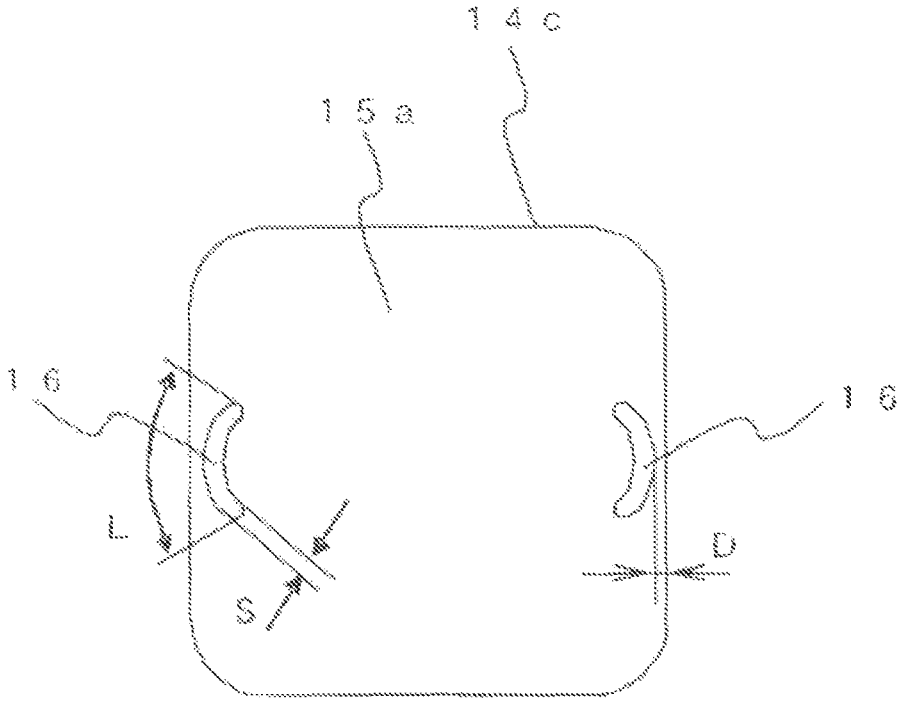
FIG. 21 is a further diagram illustrating the arrangement of the injection holes according to the seventh embodiment of the present invention.

Moreover, as illustrated in FIG. 16, as each of the injection holes 16 as another mode of this embodiment, the outlet side of the injection hole 16 is formed so that a sectional area of the opening in the short side direction becomes larger to the downstream side. With the configuration described above, the spread of the liquid film 17 of the injected fuel becomes larger to accelerate the reduction in the thickness of the film. Moreover, as each of the injection holes 16 as another mode of this embodiment, the outlet side of each of the injection holes 16 is formed so that the cross section of the opening in the short side direction is reduced to the downstream side as illustrated in FIG. 17. With the configuration described above, the turbulence of the fuel flow at the upstream of each of the injection holes 16 is suppressed. Therefore, the liquid film 17 of the injected fuel is smoothed to improve the atomization characteristics after breakup. Also in the configurations illustrated in FIGS. 15 to 17, the length L of the injection hole 16 in the long side direction and the length S in the short side direction have the relationship: $1<L/S<12$, as in the case of the first embodiment. The relationship between the height H of the fuel chamber 15*a* and the length S of the injection hole in the short side direction is $H/S<10$.

Seventh Embodiment

Although the example where each of the injection holes has the approximately oblong slit-like shape has been described and illustrated in the first to sixth embodiments, the slit-like shape may be variously changed as follows. FIGS. 18 to 22 are schematic views illustrating the shape of each of the injection holes 16 of the fuel injection valve 1 according to a seventh embodiment of the present invention. In the drawings, the same parts as or corresponding parts to those illustrated in FIGS. 1 to 7 are denoted by the same reference symbols, and the description thereof is herein omitted. In this embodiment, the slit-like injection holes 16 (appropriately elliptical shape (FIG. 18), rhombus shape (FIG. 19), wedge shape (FIG. 20), horseshoe shape (FIG. 21)) are arranged in the vicinity of the wall surface 14*c* of the side wall of the fuel chamber 15*a* so that the long axis directions become parallel to the wall surface 14*c*. The length L of the injection hole 16 in the long axis direction and the length S in the short axis direction have the relationship: $1<L/S<12$, as in the case of the first embodiment. The relationship between the height H of the fuel chamber 15*a* and the length S of the injection hole in the short axis direction is $H/S<10$.

Figure 22:
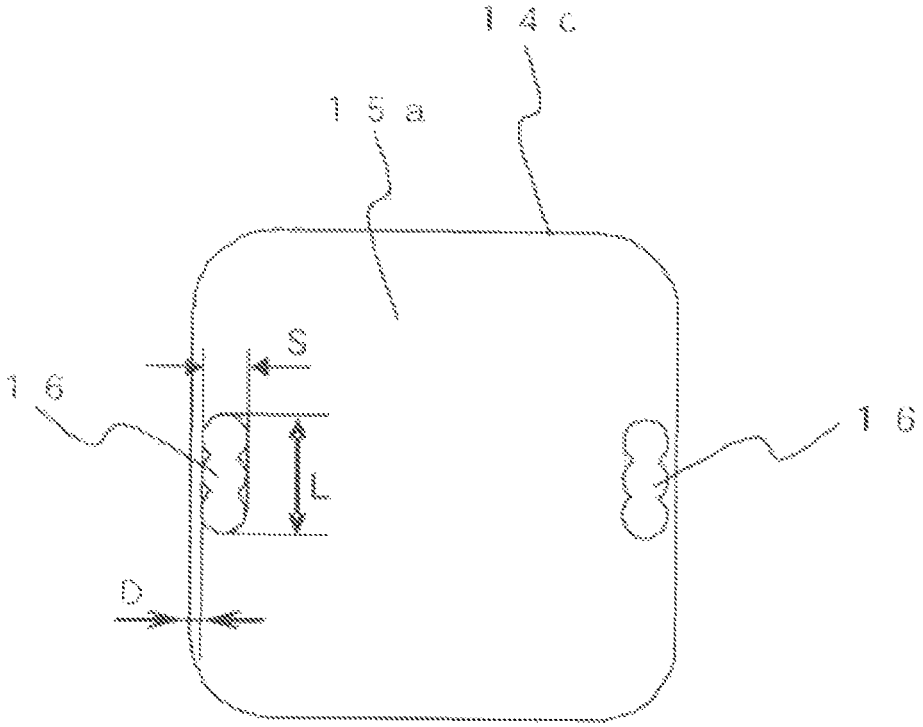
FIG. 22 is a further diagram illustrating the arrangement of the injection holes according to the seventh embodiment of the present invention.

With the configuration described above, the balance of the flows of the fuel into each of the injection holes 16 can be changed. As a result, a direction of the injection of the liquid film 17 can be freely changed. Moreover, each of the injection holes 16 as another mode of this embodiment has a slit-like shape obtained by connecting circular holes, as illustrated in FIG. 22. By the configuration described above, each of the injection holes 16 can be formed by continuously processing the circular holes. Therefore, workability is significantly improved.

Eighth Embodiment

Figure 23:
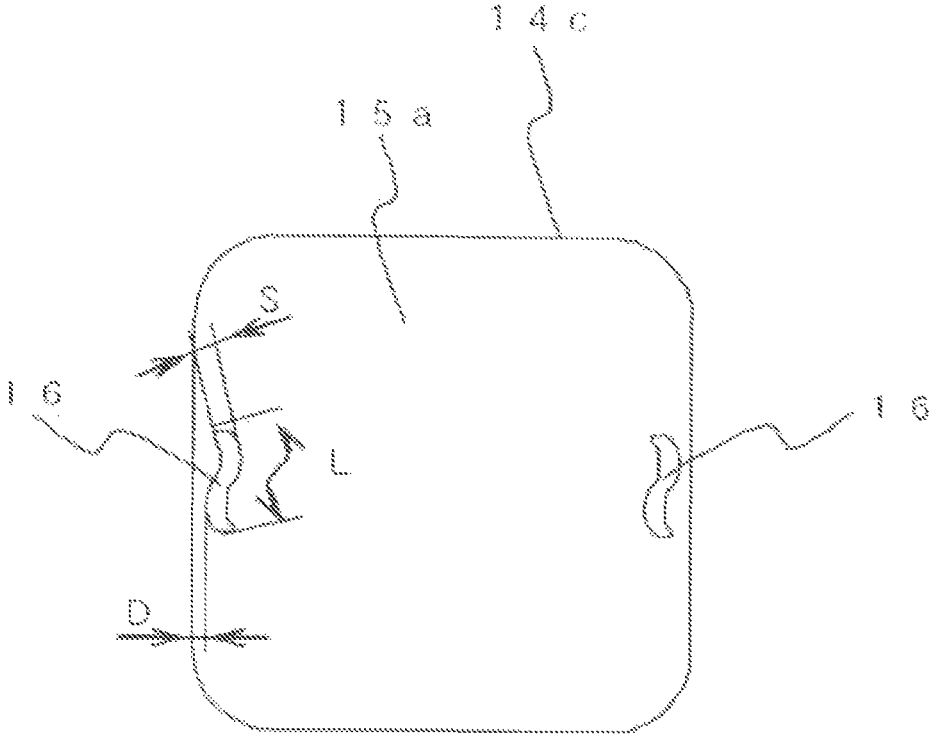
FIG. 23 is a diagram illustrating the arrangement of injection holes according to an eighth embodiment of the present invention.

The injection holes may be formed as the slit-like injection holes 16 twisted into an S-like shape in the first to seventh embodiments. FIG. 23 is a schematic view illustrating the shape of each of the injection holes 16 of the fuel injection valve 1 according to an eighth embodiment of the present invention. In the drawings, the same parts as or corresponding parts to those illustrated in FIGS. 1 to 7 are denoted by the same reference symbols, and the description thereof is herein omitted. In this embodiment, the S-like shaped slit-like injection holes 16 are arranged in the vicinity of the wall surface 14*c* of the side wall of the fuel chamber 15*a*. The length L of the injection hole 16 in the long axis direction and the length S in the short axis direction have the relationship: $1<L/S<12$, as in the case of the first embodiment. The relationship between the height H of the fuel chamber 15*a* and the length S of the injection hole in the short axis direction is $H/S<10$.

With the injection holes 16 configured as described above, the flow of the fuel is rectified by the wall surface 14*c* to intensify the flow in the long axis direction of each of the slit-like injection holes 16. As a result, the reduction of the film thickness of the fuel flowing out of each of the injection holes 16 is further improved. Moreover, by forming each of the injection holes 16 into the S-like shape, the flows of the fuel injected out of the injection holes 16 collide against each other with a slight offset. Therefore, the liquid film 17 formed after the collision is also twisted into the S-like shape. Therefore, a contact area of the atmosphere increases as compared with the liquid film 17 formed to have parallel surfaces. Therefore, the evaporation of the injected fuel is accelerated to enable the improvement of exhaust gas characteristics.

Ninth Embodiment

Figure 24:
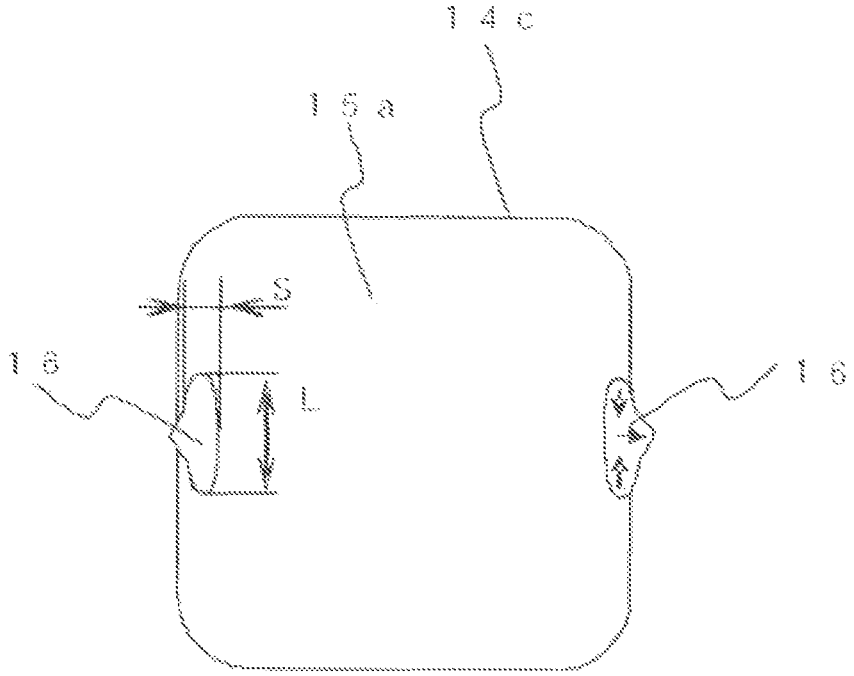
FIG. 24 is a diagram illustrating the arrangement of injection holes according to a ninth embodiment of the present invention.

In the first to sixth embodiments, the shape of each of the injection holes 16 of the fuel injection valve 1 may be formed as an approximately T-like shape, and each of the injection holes 16 may be formed so as to partially overlap the wall surface 14*c* of the fuel chamber 15*a*. FIG. 24 is a schematic view illustrating the shape of each of the injection holes 16 of the fuel injection valve 1 according to a ninth embodiment of the present invention. In the drawings, the same parts as or corresponding parts to those illustrated in FIGS. 1 to 7 are denoted by the same reference symbols, and the description thereof is herein omitted. In this embodiment, each of the approximately T-like shaped injection holes 16 is formed to pass through the injection hole plate 15 so as to partially overlap the wall surface 14*c* of the fuel chamber 15*a*. The length L of the injection hole 16 in the long axis direction and the length S in the short axis direction have the relationship: 1<L/S<12, as in the case of the first embodiment. The relationship between the height H of the fuel chamber 15*a* and the length S of the injection hole in the short axis direction is H/S<10. Further, as in the case of the third embodiment, the amount of the injection hole, which overlaps the wall surface 14*c*, is S/2 or less.

In each of the injection holes 16 configured as described above, as in the case of the third embodiment, the flow from the wall surface 14*c* toward the center axis of the fuel injection valve is suppressed to stabilize the flow of the fuel. Moreover, each of the injection holes 16 is formed into the approximately T-like shape. As a result, after the flows in the long axis direction collide against each other in each of the injection holes 16, the flows move into a convex portion of the approximately T-like shaped injection hole. As a result, the liquid film 17 formed after the collision further widely spreads to enable the acceleration of the reduction of the film thickness of the fuel.

Tenth Embodiment

Figure 26:
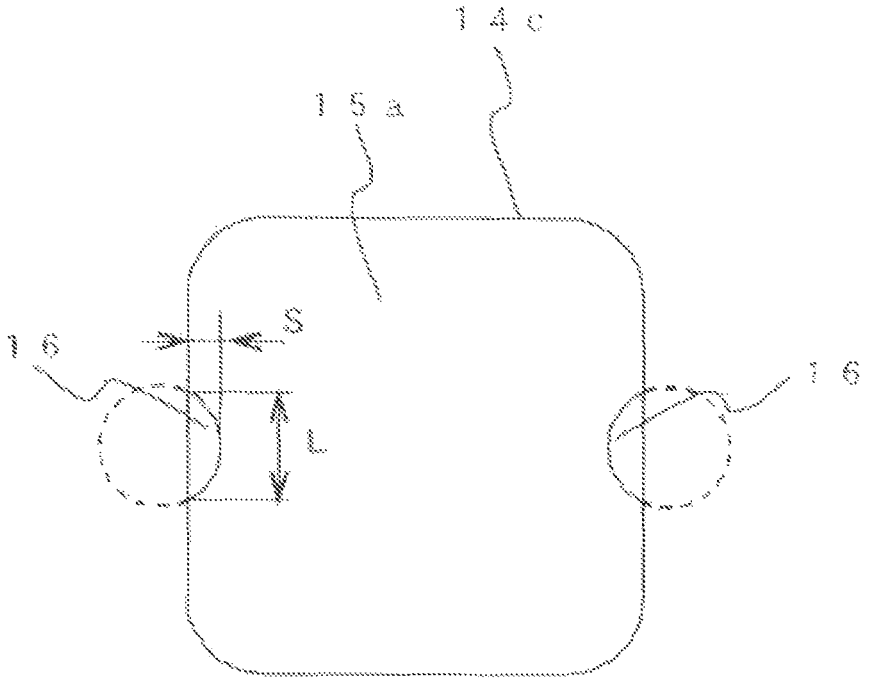
FIG. 26 is a diagram illustrating the arrangement of injection holes according to the tenth embodiment of the present invention.

Although the example where the opening of each of the injection holes 16 is formed by the opening of each of the through holes of the injection hole plate 15 has been described and illustrated in the first to ninth embodiments, the opening of each of the injection holes 16 may be formed by different members such as the injection hole plate 15 and the valve seat 14 or the like. FIG. 25 is a sectional view of the vicinity of the injection hole 16 of the fuel injection valve 1 according to a tenth embodiment of the present invention. In the drawings, the same parts as or corresponding parts to those illustrated in FIGS. 1 to 7 are denoted by the same reference symbols, and the description thereof is herein omitted. Further, FIG. 26 is a schematic view illustrating the shape of each of the injection holes 16 according to this embodiment. In this embodiment, circular through holes which are open to the outer side of the wall surface 14*c* of the fuel chamber 15*a* formed by the valve seat 14 are formed through the injection hole plate 15 so as to form the injection holes 16, each having the opening surrounded by the wall surface 14*c* and the injection hole plate 15. The length L of the injection hole 16 in the long axis direction and the length S in the short axis direction have the relationship: 1<L/S<12, as in the case of the first embodiment. The relationship between the height H of the fuel chamber 15*a* and the length S of the injection hole in the short axis direction is H/S<10. With the injection holes 16 described above, the gap between each of the injection holes 16 and the wall surface 14*c* can be totally reduced to zero. Therefore, the turbulence in each of the injection holes 16 is suppressed to accelerate the reduction of the film thickness.

Eleventh Embodiment

Figure 27:
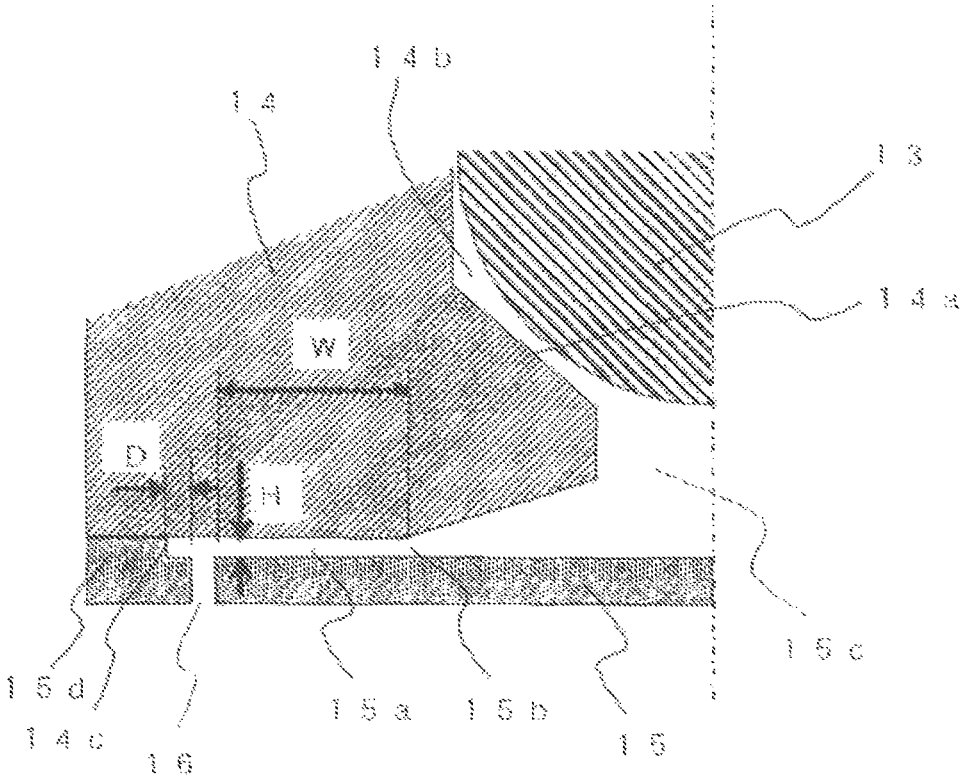
FIG. 27 is a schematic sectional view of a fuel injection valve according to an eleventh embodiment of the present invention.

Although the example where the upper surface of the injection hole plate 15 is flat and the concave portion is formed on the lower surface of the valve seat 14 to form the fuel chamber 15*a* has been described and illustrated in the first to tenth embodiments as illustrated in FIG. 2, the concave portion may be formed on the upper surface of the injection hole plate 15 to form the fuel chamber 15*a* as in the case of the eleventh embodiment. FIG. 27 is a sectional view of the vicinity of the injection hole 16 of the fuel injection valve 1 according to this embodiment. In the drawings, the same parts as or corresponding parts to those illustrated in FIGS. 1 to 7 are denoted by the same reference symbols, and the description thereof is herein omitted. In this case, a convex portion 15*d* is formed on an outer circumferential portion of the injection hole plate 15. The injection hole plate 15 and the valve seat 14 are connected by welding on the top of the concave portion 15*d*. The fuel chamber 15*a* is formed between the concave portion in the center of the injection hole plate 15 and the valve seat 14. An inner wall surface of the convex portion 15*d* provided on the outer circumferential portion of the injection hole plate 15 serves as the wall surface 14*c* of the fuel chamber 15*a*.

Figure 28:
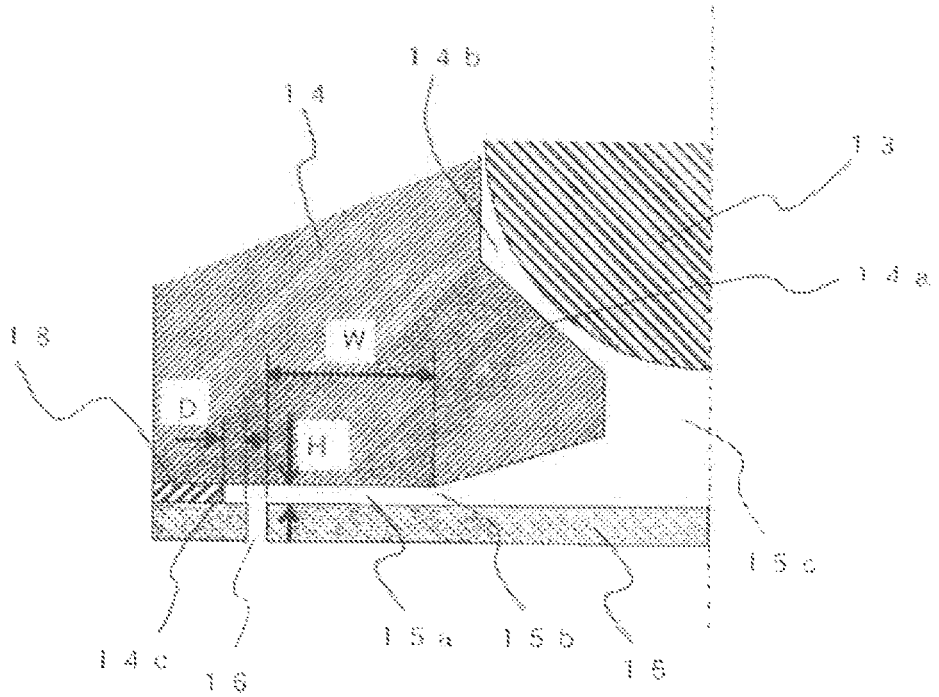
FIG. 28 is another schematic sectional view of the fuel injection valve according to the eleventh embodiment of the present invention.
Figure 29:
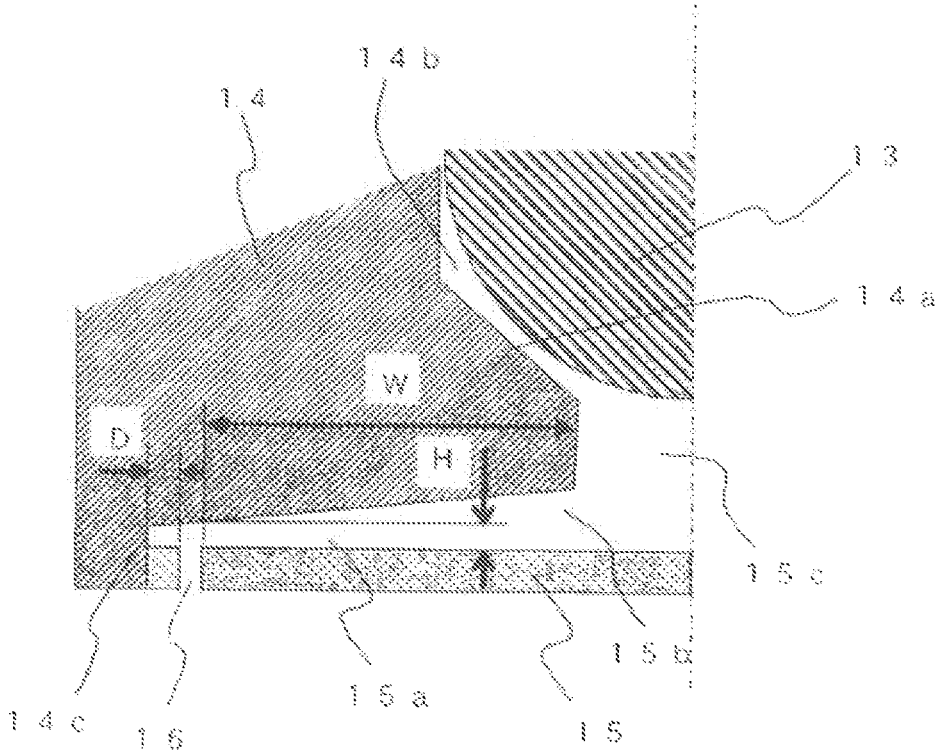
FIG. 29 is a further schematic sectional view of the fuel injection valve according to the eleventh embodiment of the present invention.

In the fuel injection valve 1 configured as described above, the wall surface 14*c* of the fuel chamber 15*a* and the injection holes 16 are formed by the same injection hole plate 15. Therefore, the positions of the wall surface 14*c* and the injection holes 16 are determined based only on processing accuracy without depending on positioning accuracy with respect to the valve seat 14. Therefore, variability of the fuel injection valve 1 is reduced. As illustrated in FIG. 28, in place of the convex portion 15*d* formed on the outer circumferential portion of the injection hole plate 15, a different member 18 may be interposed between the injection hole plate 15 and the valve seat 14 to form the wall surface 14*c* of the combustion chamber 15*a*. Moreover, as illustrated in FIG. 29, the height of the fuel chamber 15*a* may be configured to be reduced toward the outer side. With the configuration described above, the turbulence in the downstream opening of the fuel path 14*b* of the valve seat 14 can be alleviated. The liquid film 17 is smoothed to improve the atomization characteristics.

Twelfth Embodiment

Figure 30:
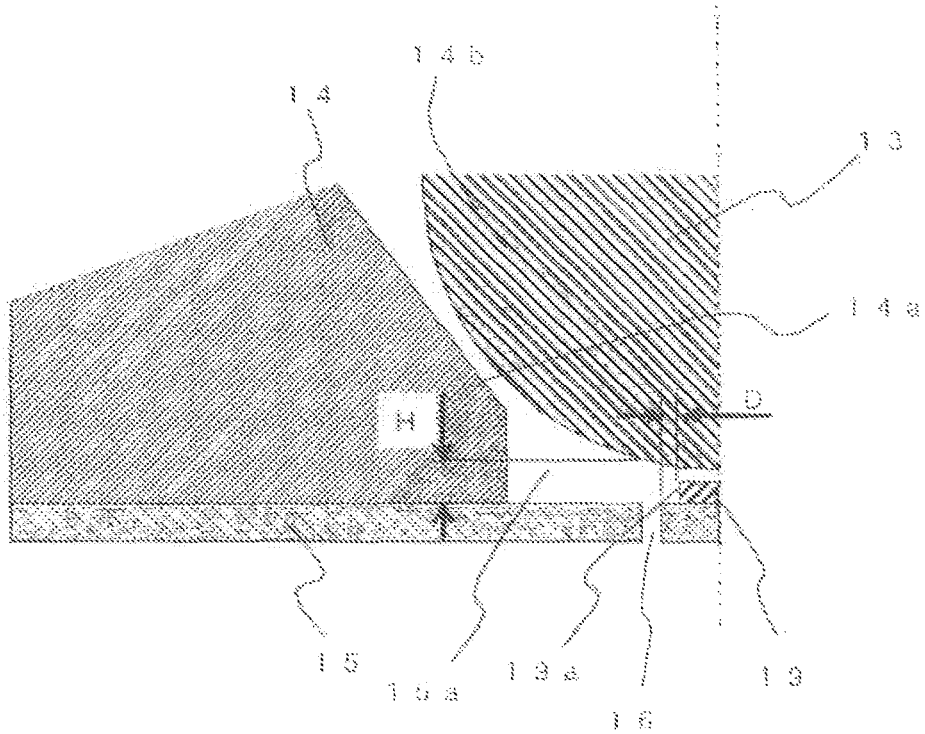
FIG. 30 is a schematic sectional view of a fuel injection valve according to a twelfth embodiment of the present invention.

Although the example where the combustion chamber 15*a* is provided around the valving element 13 has been described and illustrated in the first to eleventh embodiments, the fuel chamber 15*a* may be provided below the valving element 13. FIG. 30 is a sectional view of the vicinity of the injection hole 16 of the fuel injection valve 1 according to a twelfth embodiment of the present invention. In the drawings, the same parts as or corresponding parts to those illustrated in FIGS. 1 to 7 are denoted by the same reference symbols, and the description thereof is herein omitted. In this embodiment, as illustrated in FIG. 30, a projection 19 is provided to a center portion (at a position which is the closest to the valving element 13) of the injection hole plate 15. Each of the slit-like injection holes 16 is formed in the proximity to the projection 19. A side wall surface 19*a* of the projection 19 corresponds to the wall surface 14*c* of the fuel chamber 15*a* of the second embodiment. A distance between each of the injection holes 16 and the valving element 13 immediately above the injection holes 16 corresponds to the height H of the fuel chamber 15*a* immediately above the injection holes 16. The length L of the injection hole 16 in the long side direction and the length S in the short side direction have the relationship: 1<L/S<12, as in the case of the first embodiment. The relationship between the height H of the fuel chamber 15*a* and the length S of the injection hole in the short side direction is H/S<10.

In the fuel injection valve 1 configured as described above, the spread of the liquid film 17 of the injected fuel becomes larger to accelerate the reduction of the film thickness. Moreover, in contrast to the configuration of the second embodiment, the fuel does not flow to the outer side again when once gathered in the center. Therefore, the turbulence of the fuel flow is small. As a result, the liquid film 17 is smoothed. Further, the effect of accelerating the atomization is provided.

Thirteenth Embodiment

Figure 31:
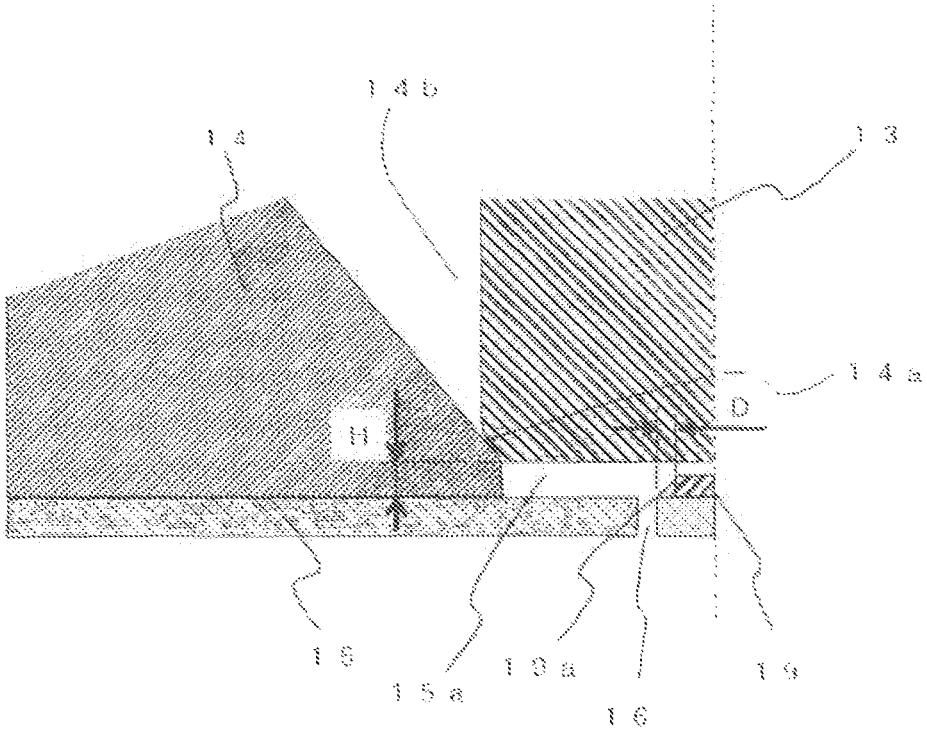
FIG. 31 is a schematic sectional view of a fuel injection valve according to a thirteenth embodiment of the present invention.

Although the distal end portion of the valving element 13 is formed to have a ball-like shape has been described and illustrated in the first to twelfth embodiments, the distal end portion of the valving element 13 may be formed to have a flat cylindrical shape. FIG. 31 is a sectional view of the vicinity of the injection holes 16 of the fuel injection valve 1 according to a thirteenth embodiment of the present invention. In the drawings, the same parts as or corresponding parts to those illustrated in FIGS. 1 to 7 are denoted by the same reference symbols, and the description thereof is herein omitted. This embodiment has the same configuration as that of the twelfth embodiment. However, the valving element 13 is formed into a cylindrical shape having a smooth distal end portion. In this embodiment, as illustrated in FIG. 31, the projection 19 is provided to a center portion of the injection hole plate 15. Each of the slit-like injection holes 16 is formed in the proximity to the projection 19. The side wall surface 19*a* of the projection 19 corresponds to the wall surface 14*c* of the fuel chamber 15*a* of the second embodiment. A distance between each of the injection holes 16 and the valving element 13 immediately above the injection holes 16 corresponds to the height H of the fuel chamber 15*a* immediately above the injection holes 16. The length L of the injection hole 16 in the long side direction and the length S in the short side direction have the relationship: $1<L/S<12$, as in the case of the first embodiment. The relationship between the height H of the fuel chamber 15*a* and the length S of the injection hole in the short side direction is $H/S<10$.

In the fuel injection valve 1 configured as described above, the spread of the liquid film 17 of the injected fuel becomes larger to accelerate the reduction of the film thickness. Moreover, the fuel does not flow to the outer side again when once gathered in the center. Therefore, the turbulence of the fuel flow is small. As a result, the liquid film 17 is smoothed. Further, the effect of accelerating the atomization is provided. Further, the distal end portion of the valving element 13 has a flat portion. Therefore, the distance between the injection holes 16 and the valving element 13 immediately above the injection holes 16 is constant. Therefore, even when the positions of the injection holes 16 are shifted by some degrees, the height H of the fuel chamber 15*a* immediately above the injection holes 16 becomes constant. Therefore, the effect of reducing the variability is also provided.

Fourteenth Embodiment

Figure 32:
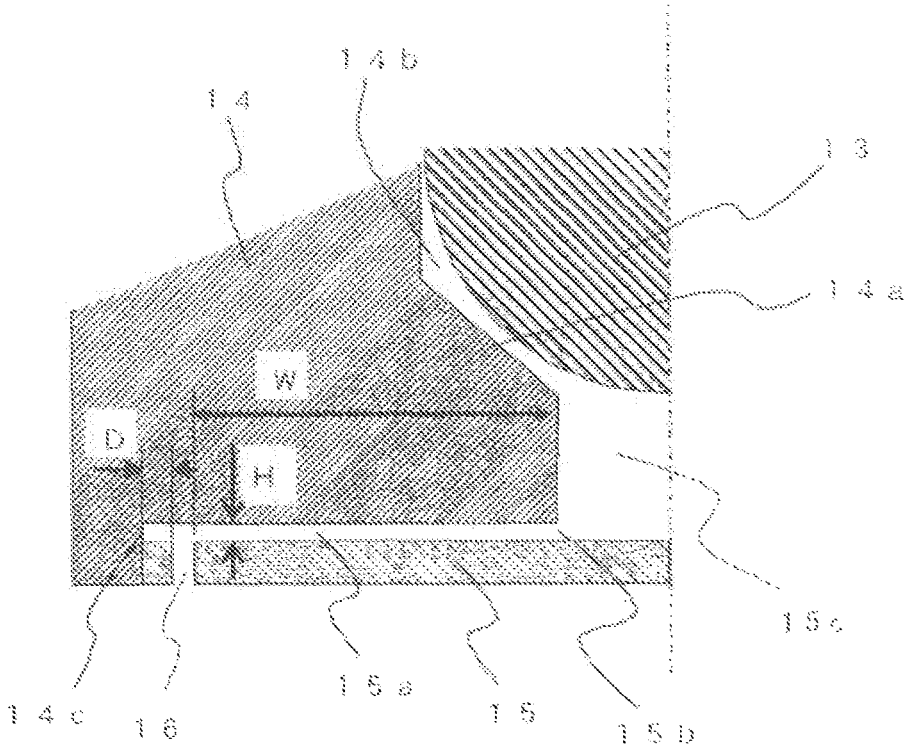
FIG. 32 is a schematic sectional view of a fuel injection valve according to a fourteenth embodiment of the present invention.

In the first to eleventh embodiments, an opening area of the portion of the inlet 15*b* of the fuel chamber 15*a* may be set smaller than a total opening sectional area of all the injection holes 16. FIG. 32 is a sectional view of the vicinity of the injection hole 16 of the fuel injection valve 1 according to a fourteenth embodiment of the present invention. In the drawings, the same parts as or corresponding parts to those illustrated in FIGS. 1 to 7 are denoted by the same reference symbols, and the description thereof is herein omitted. In this embodiment, the configuration is the same as that of the second embodiment. However, the sectional area (opening area) of the portion of the inlet 15*b* of the fuel chamber 15*a* is configured to be smaller than the total sectional area of all the injection holes 16. The length L of the injection hole 16 in the long side direction and the length S in the short side direction have the relationship: $1<L/S<12$, as in the case of the first embodiment. The relationship between the height H of the fuel chamber 15*a* and the length S of the injection hole in the short side direction is $H/S<10$.

Figure 33:
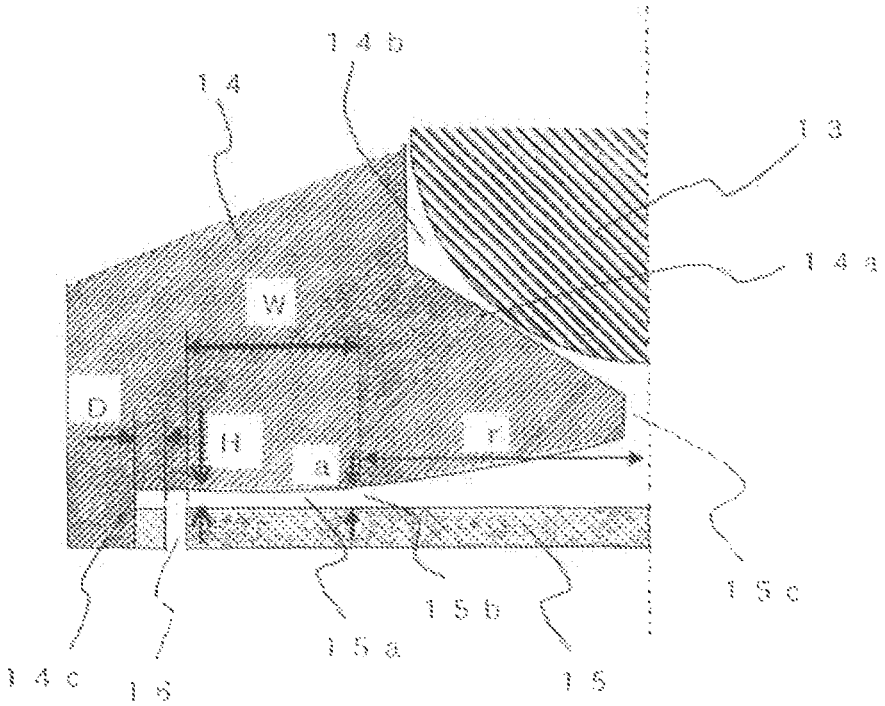
FIG. 33 is another schematic sectional view of the fuel injection valve according to the fourteenth embodiment of the present invention.

In the fuel injection valve 1 configured as described above, the spread of the liquid film 17 of the injected fuel becomes larger to accelerate the reduction in the film thickness. At the same time, the sectional area of the inlet 15*b* of the fuel chamber 15*a* located upstream of the injection valve is smaller than the total sectional area of all the injection holes 16. Therefore, the turbulence of the fuel flow in the opening of the fuel flow path of the valve seat 14 can be alleviated at the inlet 15*b*. The same effect is obtained as long as a portion having a sectional area smaller than the sectional area of the injection holes 16 is provided upstream of the injection holes 16. For example, as illustrated in FIG. 33, the sectional area of a connecting portion 15*c* between the fuel path 14*b* and the combustion chamber 15*a* may be smaller than the total sectional area of all the injection holes 16. Note that, when the distance between the lower surface of the valve seat 14 and the upper surface of the injection hole plate 15 gradually changes as illustrated in FIG. 33, the distance W only needs to be calculated so that a position at which $2\pi ra$ becomes the smallest as the inlet 15*b* of the fuel chamber 15*a* when a distance from a center axis of the injector is r and a distance between the valve seat 14 and the injection plate 15 at that position is a.

Fifteenth Embodiment

Figure 34:
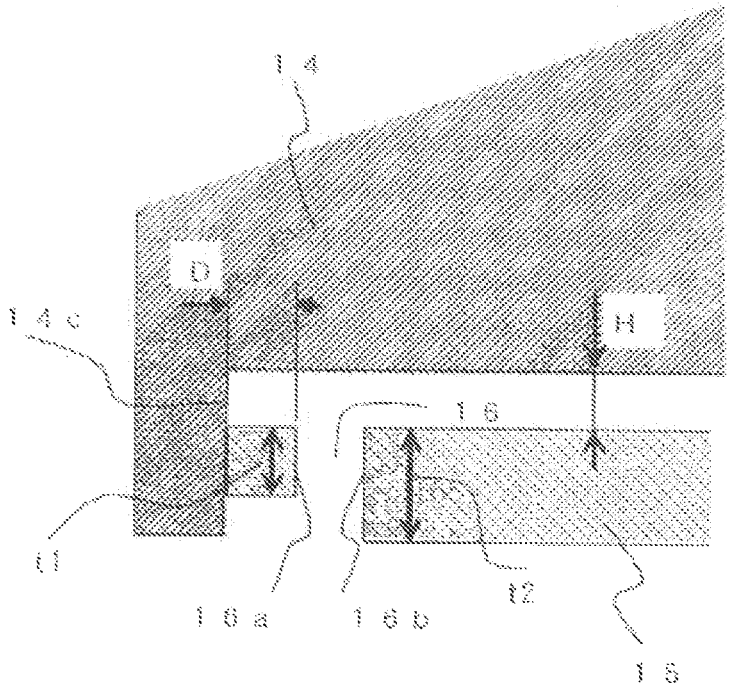
FIG. 34 is a schematic sectional view of a fuel injection valve according to a fifteenth embodiment of the present invention.

Although the example where the inner wall surface of each of the injection holes 16 has the same depth (length of the fuel injection valve 1 in the axis direction) over the entire circumference has been described and illustrated in the first to fourteenth embodiments, the depth of the inner wall surface of each of the injection holes 16 may be changed in the circumferential direction. In particular, a portion of the inner wall surface of each of the injection holes 16 on the side close to the upstream side and a portion of the inner wall surface, which is opposed thereto, may have different depths. FIG. 34 is a sectional view of the vicinity of the injection hole 16 of the fuel injection valve 1 according to a fifteenth embodiment of the present invention. In the drawings, the same parts as or corresponding parts to those illustrated in FIGS. 1 to 7 are denoted by the same reference symbols, and the description thereof is herein omitted. In this embodiment, the configuration is the same as that of the second embodiment. However, of the inner wall surface of each of the injection holes 16, a depth of an inner wall surface portion 16*a* on the side closer to the wall surface 14*c* is set smaller than a depth of an inner wall surface portion closer to the inlet 15*b* of the fuel chamber 15*a*. As a result, a flow path length t1 of a flow path inside the injection hole on the inner wall surface portion 16*a* side and a flow path length t2 on the inner wall surface portion 16*b* side have the relationship $t1<t2$. The length L of the injection hole 16 in the long side direction and the length S in the short side direction have the relationship: $1<L/S<12$, as in the case of the first embodiment. The relationship between the height H of the fuel chamber 15*a* and the length S of the injection hole in the short side direction is H/S<10.

Figure 35:
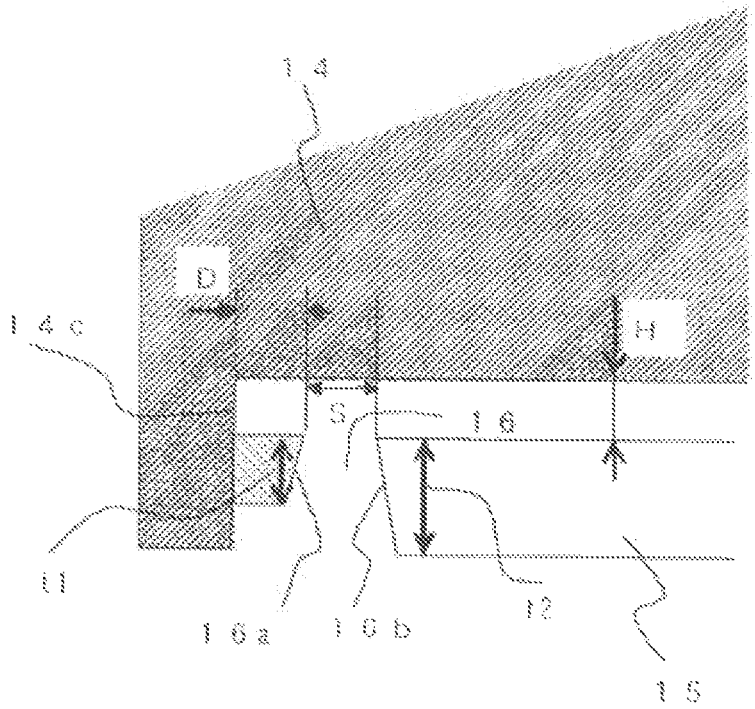
FIG. 35 is another schematic sectional view of the fuel injection valve according to the fifteenth embodiment of the present invention.
Figure 36:
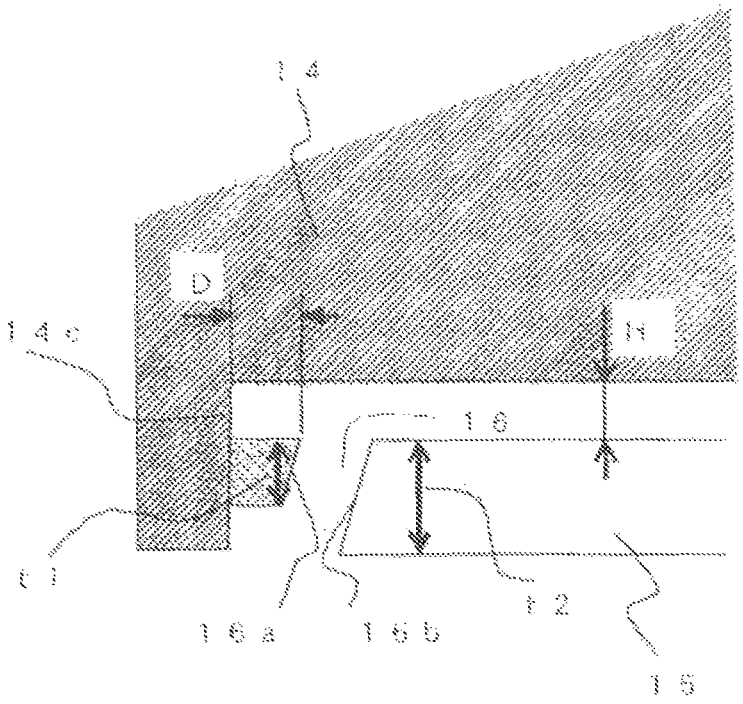
FIG. 36 is a further schematic sectional view of the fuel injection valve according to the fifteenth embodiment of the present invention.

In the fuel injection valve 1 according to the first embodiment, the flows of the fuel are pressed against the inner wall surface portion 16*a* close to the wall surface 14*c* and collide against each other from the inside of the injection holes 16 to a space directly under the injection holes. The fuel spreads after flowing out of each of the injection holes 16 to become the liquid film 17. In the fuel injection valve 1 according to this embodiment, the flow path length t1 on the wall surface 14*c* side is set shorter than the flow path length t2 of the surface opposed thereto. In this manner, the position at which the liquid film 17 starts spreading is located on the further upstream side. As a result, the spread of the liquid film 17 in the direction toward the wall surface 14*c* is accelerated. The effect of accelerating the atomization is obtained. Moreover, the plate thickness of the entire injection hole plate 15 is not necessarily required to be reduced. Therefore, the reduction in strength can be minimized. This embodiment is applicable even to a configuration in which the opening sectional area in the short side direction becomes larger toward the outlet side as illustrated in FIG. 35 and a configuration in which each of the injection holes 16 is formed as a slant through hole as illustrated in FIG. 36.

Sixteenth Embodiment

Figure 37:
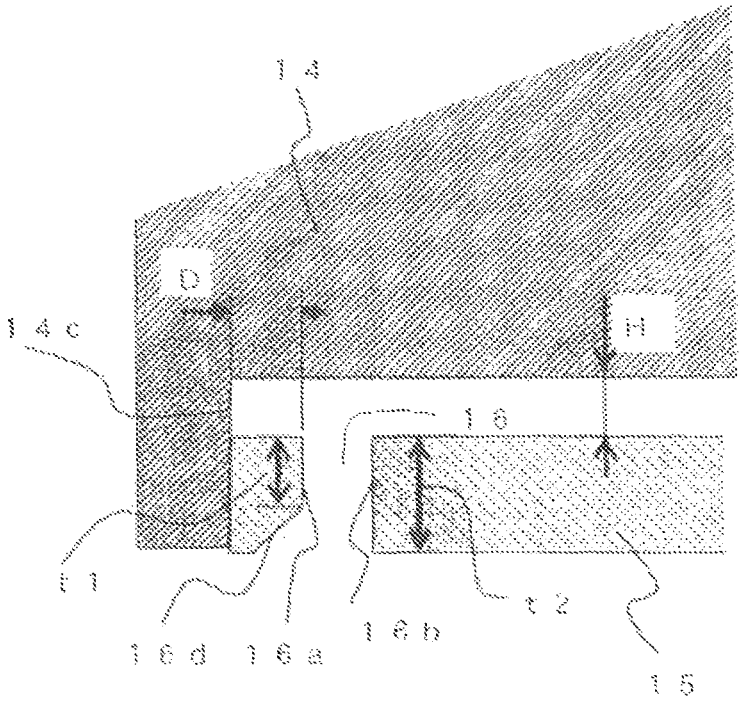
FIG. 37 is a schematic sectional view of a fuel injection valve according to a sixteenth embodiment of the present invention.

In the fifteenth embodiment, of the inner wall surface of each of the injection holes 16, the depth of the inner wall surface portion 16*a* on the side closer to the wall surface 14*c* is reduced to reduce the flow path length t1 on the inner wall surface portion 16*a*. However, the flow path length t1 may also be reduced by providing a bent portion toward the wall surface 14*c* to the inner wall surface portion 16*a*. FIG. 37 is a sectional view of the vicinity of the injection hole 16 of the fuel injection valve 1 according to a sixteenth embodiment of the present invention. In the drawings, the same parts as or corresponding parts to those illustrated in FIGS. 1 to 7 are denoted by the same reference symbols, and the description thereof is herein omitted. In this embodiment, the configuration is the same as that of the second embodiment. However, by providing a chamfered portion 16*d* to the vicinity of the outlet of the inner wall surface portion 16*a*, a bent portion toward the wall surface 14*c* is provided to the inner wall surface portion 16*a* so that the flow path length t1 becomes smaller than the flow path length t2. The relationship between the flow path length t1 and the flow path length t2 is t1<t2 as in the case of the fifteenth embodiment. Therefore, the effect of similarly accelerating the spread of the liquid film 17 in the direction toward the wall surface 14*c* to accelerate the atomization is obtained. Moreover, the plate thickness of the injection hole plate 15 is not required to be changed. Therefore, the strength is not lowered. The case where the lower surface of the injection hole plate 15 projects beyond the lower surface of the valve seat 14 is exemplified herein. However, the lower surface of the injection hole plate 15 and the lower surface of the valve seat 14 may be aligned with each other in height. Alternatively, the lower surface of the valve seat 14 may project beyond the lower surface of the injection hole plate 15.

Seventeenth Embodiment

Figure 38:
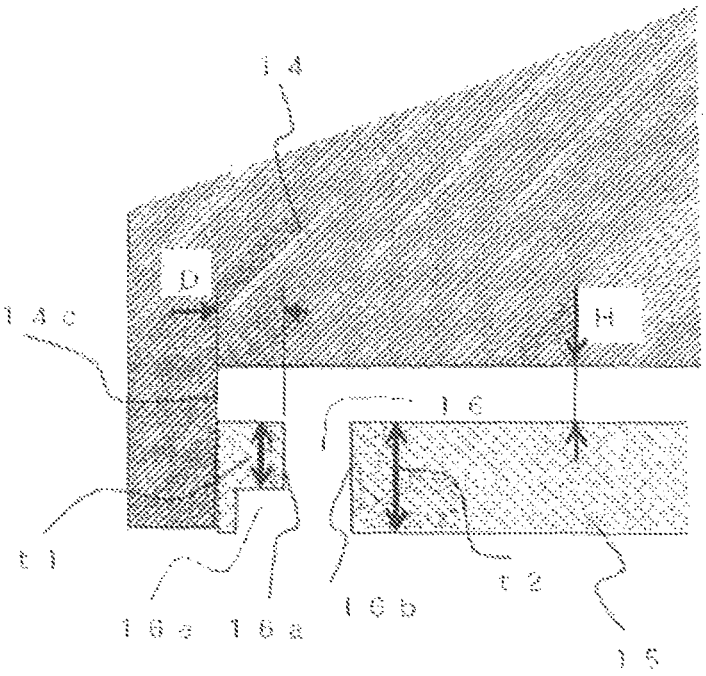
FIG. 38 is a schematic sectional view of a fuel injection valve according to a seventeenth embodiment of the present invention.

Although the bent portion toward the wall surface 14*c* is provided to the inner wall surface portion 16*a* by providing the chamfered portion 16*d* in the vicinity of the outlet of the inner wall surface portion 16*a* in the sixteenth embodiment, the bent portion may be provided by a counterboring. FIG. 38 is a sectional view of the vicinity of the injection hole 16 of the fuel injection valve 1 according to a seventeenth embodiment of the present invention. In the drawing, the same parts as or corresponding parts to those illustrated in FIGS. 1 to 7 are denoted by the same reference symbols, and the description thereof is herein omitted. In this embodiment, the configuration is the same as that of the second embodiment. However, a counterboring 16*e* is provided to a downstream side portion of the inner wall surface portion 16*a*, which is close to the wall surface 14*c*. Only for the inner wall surface portion 16*a* to which the counterboring 16*e* is provided, the relationship between the flow path lengths is set as t1<t2. The flows of the fuel collide against each other in the vicinity of the center of each of the injection holes 16 to spread. Therefore, when the flow path lengths are set to satisfy t1<t2 only for the central portion of the inner wall surface portion 16*a*, the same effects as those obtained in the fifteenth embodiment can be obtained. The plate thickness of the injection hole plate 15 is not required to be changed. Therefore, the strength is not lowered. Moreover, the liquid film 17 spreads in accordance with a direction of the counterboring 16*e*. Therefore, by changing the position of the counterboring 16*e*, the direction of spread of the liquid film 17 can be controlled.

Eighteenth Embodiment

Figure 39:
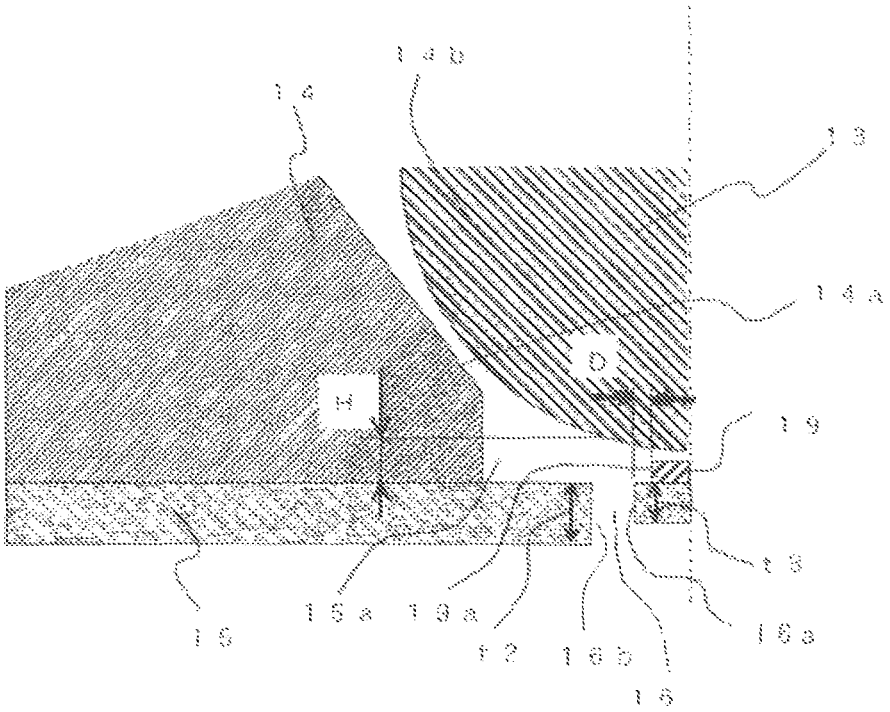
FIG. 39 is a schematic sectional view of a fuel injection valve according to an eighteenth embodiment of the present invention.

In the configuration in which the flow path lengths are set to satisfy t1<t2 as in the case of the fifteenth to seventeenth embodiments, the fuel chamber 15*a* may be provided below the valving element 13. FIG. 39 is a sectional view of the vicinity of the injection hole 16 of the fuel injection valve 1 according to an eighteenth embodiment of the present invention. In this embodiment, the projection 19 is provided in the center portion (at the position closest to the valving element 13) of the injection hole plate 15 as in the case of the twelfth embodiment. The slit-like injection holes 16 are provided in proximity to the projection 19. The flow path length t2 of the inner wall surface portion 16*b* of the flow path inside the injection hole, which faces a flow path length t3 of the inner wall surface portion 16*a* which is close to the projection 19, has a relationship: t3<t2. The thus configured fuel injection valve 1 accelerates the spread of the liquid film 17 as in the case of the fifteenth embodiment. As a result, the effect of accelerating the atomization is obtained. Moreover, the configuration of this embodiment is applicable to the other embodiments described above.

Figure 41:
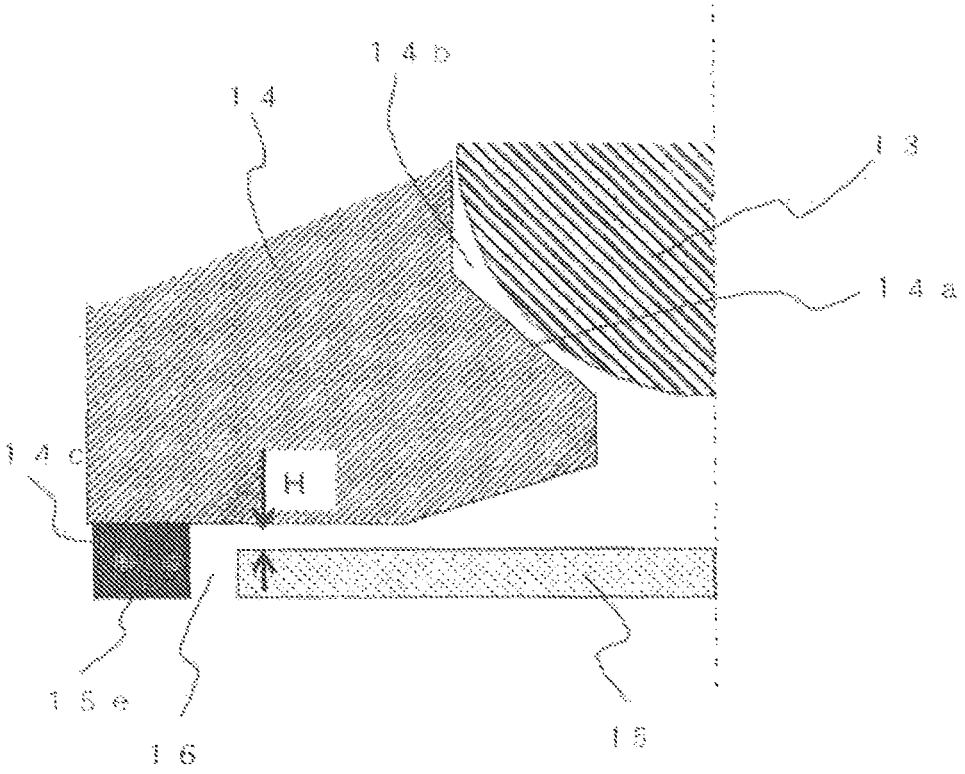
FIG. 41 is a schematic sectional view of a variation of the fuel injection valve according to any one of the first to eighteenth embodiments of the present invention.

Although the case where the injection hole plate 15 is directly fixed to the valve seat 14 has been mainly exemplified in the first to eighteenth embodiments described above, the fixation therebetween is not limited thereto. The valve seat 14 and the injection hole plate 15 may be fixed to each other through a different member therebetween. Alternatively, for example, as illustrated in FIG. 41, the end portion of the injection hole plate 15 may be cut out to form the injection hole 16 between a different member 15*e* and the injection hole plate 15 so that the injection hole plate 15 is fixed to the different member 15*e* to be fixed to the valve seat 14 through the different member 15*e*.

Moreover, in the first to eighteenth embodiments described above, it has been described that, when the length L of the injection holes 16 in the long axis direction and the length S in the short axis direction thereof have the relationship: 1<L/S<12 and the height H of the fuel chamber 15*a* and the length S of the injection holes in the short axis direction have the relationship: H/S<10, the flows of the fuel can be made to collide against each other in the long axis direction of each of the injection holes 16 to form the liquid film 17 in the direction crossing the long axis direction. However, even when the above-mentioned relationships are not satisfied, the flows of the fuel can be made to collide against each other in the long axis direction of each of the injection holes 16 to form the liquid film 17 in the direction crossing the long axis direction. As a result, the fuel formed into the thin film can be stably injected.

The invention claimed is:

1. A fuel injection valve, comprising:

a valve seat comprising a fuel path and a valve seat portion therein;

a valve member comprising an abutment portion configured to sit on the valve seat portion, for opening and closing the fuel path through separation and contact of the abutment portion away from and with the valve seat portion;

an injection hole plate; and a fuel chamber brought into communication with the fuel path, wherein:

the fuel chamber includes a slit-like injection hole for injecting a fuel, the slit-like injection hole extending through the injection hole plate from one surface of the injection hole plate to another surface of the injection hole plate, the slit-like injection hole having a length L in a long axis direction and a length S in a short axis direction, the length L being greater than the length S;

the injection hole has a slit-like shape for making fuel flows to collide against each other in the long axis direction of the injection hole to form a liquid film in a direction crossing the long axis direction;

the long axis direction of the slit-like injection hole and a wall surface of the fuel chamber are spaced apart from each other and approximately parallel to each other; and a distance between the slit-like injection hole and the wall surface of the fuel chamber is D, the distance D being smaller than the length S of the slit-like injection hole in a short axis direction.

2. A fuel injection valve according to claim 1, wherein the injection hole allows the formation of the liquid film in the long axis direction of the injection hole and formation of the liquid film in a direction crossing the long axis direction of the injection hole at downstream side of the injection hole.

3. A fuel injection valve according to claim 1, wherein a height of the fuel chamber immediately above the slit-like injection hole is H, and a relationship 1<L/S<12 and H/S<10 is satisfied.

4. A fuel injection valve according to claim 1, wherein, a relationship 2≤L/S is satisfied.

5. A fuel injection valve according to claim 1, wherein:

the slit-like injection hole is positioned so as to partially overlap the wall surface of the fuel chamber;

an overlapping amount between the injection hole and the wall surface is X; and a relationship X<S/2 is satisfied.

6. A fuel injection valve according to claim 1, wherein the fuel chamber is formed between a space inside a concave shape formed on a lower side of the valve seat and an injection hole plate.

7. A fuel injection valve according to claim 1, wherein the fuel chamber is formed between a space inside a concave shape formed on an upper side of the injection hole plate and the valve seat.

8. A fuel injection valve according to claim 1, wherein the fuel chamber is formed with a different member interposed between the valve seat and an injection hole plate.

9. A fuel injection valve according to claim 1, wherein a distance between an inlet of the fuel chamber on an upstream side and the slit-like injection hole is W, and a relationship L/2<W is satisfied.

10. A fuel injection valve according to claim 1, wherein, when a flow path length of a portion of a flow path length in an axis direction of the fuel injection valve inside the slit-like injection hole on a side closer to a wall surface of the fuel chamber is t1 and a flow path length on a side of an opposed surface is t2, a relationship t1<t2 is satisfied.

11. A fuel injection valve, comprising:

a valve seat comprising a fuel path and a valve seat portion therein;

a valve member comprising an abutment portion configured to sit on the valve seat portion, for opening and closing the fuel path through separation and contact of the abutment portion away from and with the valve seat portion;

a fuel chamber brought into communication with the fuel path, an injection hole plate with a slit-like injection hole for injecting a fuel in the fuel chamber to outside in an injecting direction, the slit-like injection hole extending through the injection hole plate from one surface of the injection hole plate to another surface of the injection hole plate, the slit-like injection hole having a long axis and a short axis approximately perpendicular to the long axis; and a space between the slit-like injection hole and a side surface of the fuel chamber in the injecting direction, the space having a distance from the side surface of the fuel chamber to the slit-like injection hole in a direction of the short axis, wherein:

the distance is smaller than length of the short axis.

* * * * *